US008382553B2

(12) United States Patent
O'Connor

(10) Patent No.: US 8,382,553 B2
(45) Date of Patent: Feb. 26, 2013

(54) TOY TRACK SET AND RELAY SEGMENTS

(75) Inventor: Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 282 days.

(21) Appl. No.: 12/717,645

(22) Filed: Mar. 4, 2010

(65) Prior Publication Data

US 2010/0159800 A1 Jun. 24, 2010

Related U.S. Application Data

(63) Continuation-in-part of application No. 12/111,168, filed on Apr. 28, 2008, now Pat. No. 7,857,679.

(60) Provisional application No. 60/926,583, filed on Apr. 27, 2007, provisional application No. 60/966,029, filed on Aug. 24, 2007.

(51) Int. Cl.
*A63A 18/00* (2006.01)

(52) U.S. Cl. ..... 446/444; 446/429

(58) Field of Classification Search ..... 446/4, 429, 446/168, 169, 441, 91, 444; 104/53, 54, 104/55, 56, 67, 69, 79; 273/108, 459, 380
See application file for complete search history.

(56) References Cited

U.S. PATENT DOCUMENTS

| | | | | |
|---|---|---|---|---|
| 283,661 | A * | 8/1883 | Reed | 273/384 |
| 1,235,771 | A * | 8/1917 | Dettra | 446/4 |
| 1,523,243 | A | 1/1925 | Bain | |
| 2,385,724 | A * | 9/1945 | Olson | 446/6 |
| 2,416,473 | A | 2/1947 | Fields | |
| 2,735,221 | A | 2/1956 | Fields | |
| 3,025,846 | A * | 3/1962 | Crosman | 446/211 |
| 3,031,797 | A * | 5/1962 | Gelfand | 446/65 |
| 3,145,991 | A | 8/1964 | Benditt | |
| 3,148,478 | A * | 9/1964 | Miller | 124/26 |
| 3,398,956 | A * | 8/1968 | Lukes | 446/429 |
| 3,402,503 | A * | 9/1968 | Glass et al. | 446/91 |
| 3,599,365 | A | 8/1971 | Carver et al. | |
| 3,603,024 | A | 9/1971 | Davis et al. | |
| 3,633,308 | A | 1/1972 | Yang | |
| 3,734,500 | A * | 5/1973 | Cooper | 446/6 |
| 3,751,847 | A | 8/1973 | Neuhierl | |
| 3,777,391 | A | 12/1973 | Barcus et al. | |
| 3,858,875 | A * | 1/1975 | Nemeth et al. | 104/54 |
| 3,896,735 | A | 7/1975 | Fischer | |
| 3,928,934 | A | 12/1975 | Lewis et al. | |

(Continued)

FOREIGN PATENT DOCUMENTS

| | | |
|---|---|---|
| WO | 9303808 A1 | 3/1993 |
| WO | 9949948 A1 | 10/1999 |

(Continued)

OTHER PUBLICATIONS

International Search Report for PCT/US2008/061820 dated Oct. 17, 2008.

(Continued)

*Primary Examiner* — Kurt Fernstrom
*Assistant Examiner* — Urszula M Cegielnik
(74) *Attorney, Agent, or Firm* — Cantor Colburn LLP

(57) ABSTRACT

A relay for a toy is disclosed herein, the relay having: a first actuator configured to launch a first object into air; a second actuator; a release mechanism moveably secured to the second actuator for movement between a first position and a second position wherein movement of the release mechanism from either the first position towards the second position or the second position towards the first position by the first object causes the second actuator to propel a second object away from the second actuator.

18 Claims, 33 Drawing Sheets

U.S. PATENT DOCUMENTS 3,998,460 A 12/1976 Dyer
4,094,089 A 6/1978 Sano
4,128,964 A 12/1978 Ogasawara
4,140,276 A * 2/1979 Halford ..... 238/10 R
4,145,049 A * 3/1979 Papazian, Sr. ..... 273/380
4,185,409 A 1/1980 Cheng
4,219,198 A 8/1980 Meyer et al.
4,221,170 A 9/1980 Koudelka
4,249,733 A 2/1981 Eddins et al.
4,267,661 A 5/1981 Hanson
4,355,807 A 10/1982 Prehodka
4,357,778 A 11/1982 Matsumoto et al.
4,383,688 A * 5/1983 Prehodka ..... 446/444
4,401,050 A 8/1983 Britt et al.
4,423,871 A 1/1984 Mucaro
4,475,303 A 10/1984 Ribas et al.
4,479,650 A 10/1984 Neuhierl
4,504,242 A 3/1985 Crain et al.
4,509,760 A * 4/1985 Goldfarb et al. ..... 273/380
4,513,966 A 4/1985 Mucaro et al.
4,520,732 A 6/1985 Schwarzkopf
4,564,197 A 1/1986 Lambert et al.
4,605,230 A 8/1986 Halford et al.
4,639,236 A 1/1987 McKay et al.
4,644,869 A 2/1987 Rhodes
4,661,080 A 4/1987 Goldstein et al.
4,715,843 A * 12/1987 Ostendorff et al. ..... 446/429
D305,676 S 1/1990 Ngai
4,897,065 A 1/1990 Fertig et al.
4,932,917 A 6/1990 Klitsner
5,011,138 A 4/1991 Rankin
5,038,685 A 8/1991 Yoneda et al.
5,154,615 A * 10/1992 Joubert ..... 446/91
5,174,569 A 12/1992 Ngai
5,234,216 A * 8/1993 Ostendorff ..... 446/4
5,254,030 A 10/1993 Ostendorff et al.
5,299,809 A * 4/1994 Evangelista et al. ..... 446/6
5,299,969 A 4/1994 Zaruba
5,370,571 A * 12/1994 Bosch ..... 446/429
5,435,553 A 7/1995 Arima et al.
5,499,940 A 3/1996 Johnson et al.
5,542,668 A 8/1996 Casale et al.
5,586,923 A 12/1996 Hippely et al.
5,701,878 A 12/1997 Moore et al.
5,775,016 A 7/1998 Chien
5,788,553 A * 8/1998 Shivers et al. ..... 446/444
5,816,887 A * 10/1998 Rudell et al. ..... 446/456
5,819,717 A 10/1998 Johnson et al.
5,871,385 A 2/1999 Hippely et al.
5,899,789 A 5/1999 Rehkemper et al.
6,007,402 A 12/1999 Nelson, II
6,022,263 A 2/2000 Liu et al.
6,099,380 A * 8/2000 Rasmussen ..... 446/476
6,170,754 B1 1/2001 Halford
6,241,573 B1 6/2001 Ostendorff et al.
6,358,112 B1 3/2002 Lambert et al.
6,435,929 B1 8/2002 Halford
6,445,960 B1 9/2002 Borta
6,478,654 B1 11/2002 Rehkemper et al.
6,676,480 B2 1/2004 Sheltman
6,783,419 B1 8/2004 Paukert et al.
6,808,458 B1 10/2004 Jung
6,871,596 B2 3/2005 De-Gol
6,913,508 B2 7/2005 Hornsby et al.
6,951,497 B1 10/2005 Ngan
7,036,307 B2 5/2006 Rehkemper et al.
7,104,543 B2 9/2006 Wilk et al.
7,225,492 B2 6/2007 Pratt
7,618,301 B2 11/2009 Knight et al.
7,628,674 B2 * 12/2009 Nuttall et al. ..... 446/444
7,766,720 B2 8/2010 Ostendorff
7,794,301 B2 * 9/2010 Ostendorff et al. ..... 446/444
7,819,720 B2 * 10/2010 Nuttall et al. ..... 446/444
7,892,068 B2 * 2/2011 Nuttall et al. ..... 446/444
7,901,266 B2 * 3/2011 Ostendorff ..... 446/444
7,967,688 B2 6/2011 Lai et al.
2005/0191938 A1 9/2005 Sheltman et al.
2005/0287915 A1 12/2005 Sheltman et al.
2005/0287918 A1 12/2005 Sheltman et al.
2005/0287919 A1 12/2005 Sheltman et al.
2006/0286896 A1 12/2006 Bedford et al.
2006/0286897 A1 12/2006 Bedford et al.
2007/0049160 A1 3/2007 Matthes et al.
2008/0268743 A1 10/2008 O'Connor et al.
2009/0071137 A1 3/2009 Harris
2010/0096509 A1 4/2010 O'Connor
2010/0273394 A1 10/2010 O'Connor et al.
2011/0021111 A1 1/2011 Nuttall et al.

FOREIGN PATENT DOCUMENTS

WO 2007025353 A1 3/2007
WO 2008134663 A1 11/2008
WO 2009036298 A2 3/2009

OTHER PUBLICATIONS

Written Opinion of the International Searching Authority for PCT/US2008/061820 dated Oct. 17, 2008.
International Search Report for PCT/US2009/061192 dated May 10, 2010.
Written Opinion of the International Searching Authority for PCT/US2009/061192 dated May 10, 2010.
International Search Report dated Jan. 18, 2012 for International Application No. PCT/US2011/034788.
Written Opinion dated Jan. 18, 2012 for International Application No. PCT/US2011/034788.

* cited by examiner

TOY TRACK SET AND RELAY SEGMENTS

CROSS-REFERENCE TO RELATED APPLICATIONS

This application is a continuation-in-part of U.S. patent application Ser. No. 12/111,168 filed Apr. 28, 2008, which claims the benefit of U.S. Provisional Patent Application Ser. Nos. 60/926,583 filed Apr. 27, 2007 and 60/966,029 filed Aug. 24, 2007, the contents each of which are incorporated herein by reference thereto.

BACKGROUND

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

However, with many track sets, the vehicles run on a closed loop track moving through the same track features lap after lap. Although such track sets may have one or more stunt devices, a vehicle in the track set may perform the same stunt over and over as it travels along the track. Thus, even in track sets with more than one stunt device, the motion of the vehicle generally remains consistent for each vehicle as it travels along a specific section of the track. This repetitive nature of vehicle travel may result in loss of interest in the track set over a short period of time.

Some track sets have incorporated switching mechanisms to enable a user to direct a vehicle to a select travel path. However, generally such systems require manual manipulation of the track and/or manual actuation of a switch to reroute one or more vehicles traveling on the track. Play possibilities may be limited as travel along the select paths may again become repetitive over a short period of time.

Accordingly, it is desirable to provide toy track set with interchangeable elements to provide numerous configurations.

SUMMARY OF THE INVENTION

In one embodiment, a relay for a toy is provided, the relay having: a first actuator configured to launch a first object into air; a second actuator; a release mechanism moveably secured to the second actuator for movement between a first position and a second position wherein movement of the release mechanism from either the first position towards the second position or the second position towards the first position by the first object causes the second actuator to propel a second object away from the second actuator.

In another exemplary embodiment, an interchangeable toy track set is provided, the interchangeable toy track set having a plurality of interchangeable relays each of which may be coupled to each other to create a plurality of variations for the toy track set; and wherein at least one of the plurality of interchangeable relays includes: a first actuator configured to launch a first object into air; a second actuator; a release mechanism moveably secured to the second actuator for movement between a first position and a second position wherein movement of the release mechanism from either the first position towards the second position or the second position towards the first position by the first object causes the second actuator to propel a second object away from the second actuator.

In still another exemplary embodiment, a method for actuating a plurality of relays of a toy is provided, the method including the steps of: actuating a trigger of one of a plurality of interchangeable relays linked to at least one other of the plurality of interchangeable relay segments wherein actuation of the trigger causes an object to be launched into air towards another one of the one of the plurality of interchangeable relay segments, wherein at least one of the plurality of interchangeable relays has: a first actuator configured to launch the first object into the air; a second actuator; a release mechanism moveably secured to the second actuator for movement between a first position and a second position wherein movement of the release mechanism from either the first position towards the second position or the second position towards the first position by the first object causes the second actuator to propel a second object away from the second actuator.

DETAILED DESCRIPTION

This application is also related to U.S. patent application Ser. No. 12/581,762 filed on Oct. 19, 2009, the contents each of which are incorporated herein by reference thereto.

In accordance with exemplary embodiments of the present invention a customizable track set is provided. In one embodiment, the track set includes a plurality of interchangeable relay segments each of which may be coupled to each other to create a customized expandable track set. The relay segments may include one or more stunt elements and may be selectively positioned at the beginning, middle, or end of the track set. Each relay segment may be configured to enable a toy vehicle to traverse an obstacle and/or perform a stunt and launch the toy vehicle down a track towards another relay segment, which then may initiate a second vehicle to be released and traverse still another obstacle and/or perform still another stunt.

Figure 1:
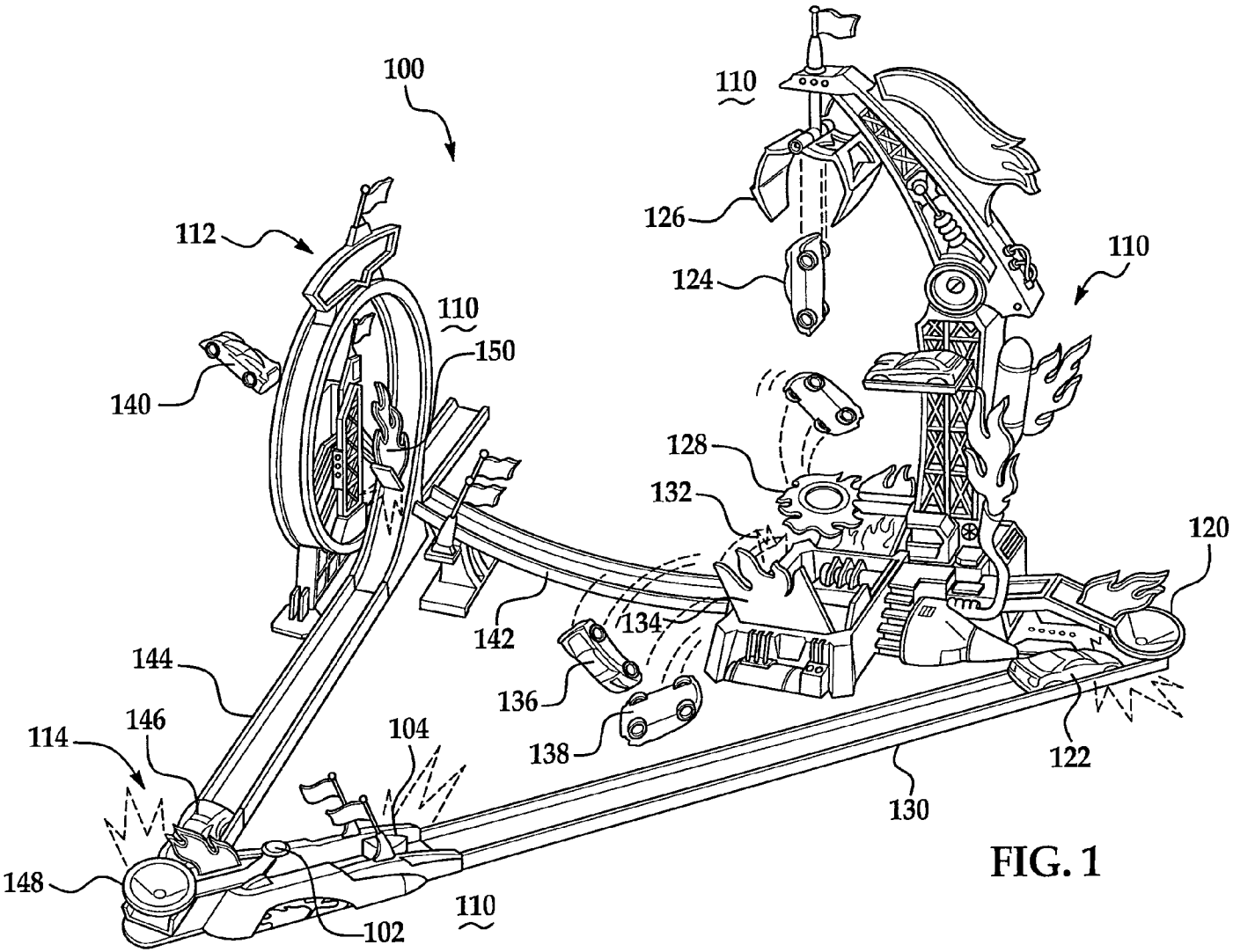
FIG. 1 shows an example toy vehicle track set including a plurality of relay segments in accordance with an exemplary embodiment of the present invention.

An example track set 100 having three relay segments 110, 112, and 114 is shown in FIG. 1. As discussed in more detail below, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

In this first example, each relay segment 110, 112, and 114 may include an incoming vehicle trigger which may directly or indirectly causes the launching of another outgoing vehicle. The outgoing vehicle from one segment may become the incoming vehicle of a next segment. One or more launchers may be provided to accelerate toy vehicles along the track. As such, the launchers may be configured to engage and urge a toy vehicle to travel along the track. It should be appreciated that although launchers are described herein, vehicles may be manually propelled along the track without the use of a launcher without departing from the scope of the disclosure.

Although any suitable launcher may be used, in the illustrated embodiments, various automatically and manually-triggered release launcher elements are illustrated. A vehicle may be positioned in launch position such that a launch element may slidingly engage the vehicle to propel the vehicle along the track. The launch element may be biased to a launch position, such as by springs, elastic bands or any other suitable biasing mechanism such that release of an activator releases its stored potential energy.

Figure 1B:
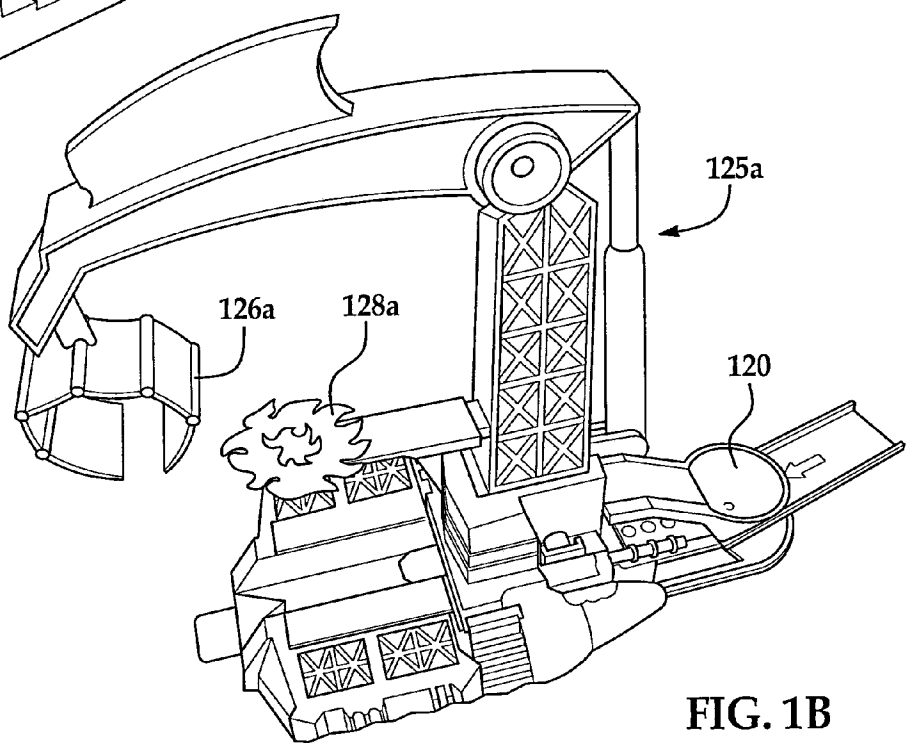
FIGS. 1*a* and 1*b* further illustrate segments of an exemplary toy vehicle track set.
Figure 1A:
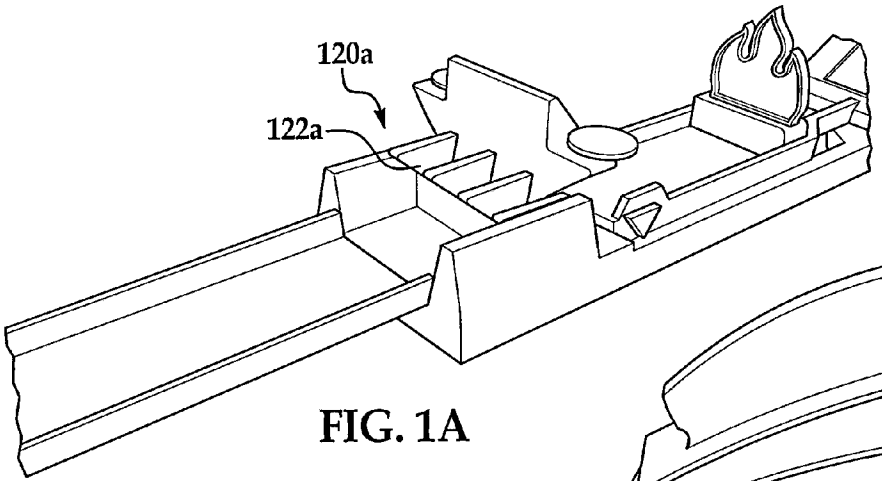

In one example, the relay segments may include triggers, such as conical shaped triggers (shown in FIG. 1 at 120) or angled trigger shapes that are not necessarily conical (shown in FIG. 1*a* at 120*a*). As an example, conically shaped trigger 120 may have a cone angle of approximately 45 degrees, which is actuated vertically via contact with a horizontally moving incoming vehicle. It should be appreciated that the cone angle may be of any suitable angle such that an incoming vehicle actuates the trigger. Thus, as a non-limiting example the cone angle may be anywhere from 5-90 degrees.

Further, while this example shows a conical trigger, alternatively, it may be planar shaped and angled (e.g., approximately 45 degrees) relative to an incoming track. As a further example and as shown in FIG. 1*a*, trigger 120*a* may have a flat, angled plane 122*a* (formed by a plurality of ridges) that is contacted by a vehicle on a track. Again, although shown with an angle of approximately 45 degrees, any suitable angle may be applied (e.g. 5-90 degrees) such that a vehicle actuates the trigger.

In some relay segments, actuation of a trigger by a first vehicle initiates a stunt and release of a second vehicle on the track set. As an example and referring again to FIG. 1, in the configuration illustrated, track play may be commenced with stunt element or relay segment 114. For example, actuation of a manual release or manual 102 may propel or launch vehicle 122 along track 130 toward a second relay segment 110. In one example embodiment, a relay segment may enable a variable change of vehicle traveling direction (between an incoming and outgoing vehicle), thus further providing variable configurations for more diverse track play.

It is noted that track 130 includes direction indicators, such as molded-in arrows, or cut-outs which may indicate vehicle direction and/or assembly instructions for a toy track set. For example, the direction indicators may aid in the ease of assembly for an expandable track set, may provide specific direction of vehicle travel used to initiate stunts, or enable passage past obstacles. Although the direction indicators are shown as a row of cut-out arrows, it should be appreciated that the direction indicators may be of any size and/or shape to indicate assembly direction and/or vehicle travel direction. Further, although a plurality of arrows is illustrated, a single arrow or other cut-out may also be used without departing from the scope of the disclosure. Further, in some embodiments, the direction indicators may be positioned in a center of the track so that the wheels of the vehicles are not impeded. It further should be appreciated that although shown as cut-outs, the direction indicators may be surface indicators, raised moldings, etc.

Referring back to FIG. 1, vehicle 122 traveling along track 130 in the direction of the direction indicators may contact or engage a second relay segment, e.g. relay segment 110. For example, relay segment 110 may be a stunt element, such as a crane element 125. Upon contact or actuation of trigger 120 through vehicle 122, a crane stunt event may be initiated. In the crane stunt event, a second vehicle, e.g. vehicle 124, may be released from jaws 126 of crane element or crane 125. FIG. 1*b* further illustrates another embodiment of a crane relay segment.

Figure 1C:
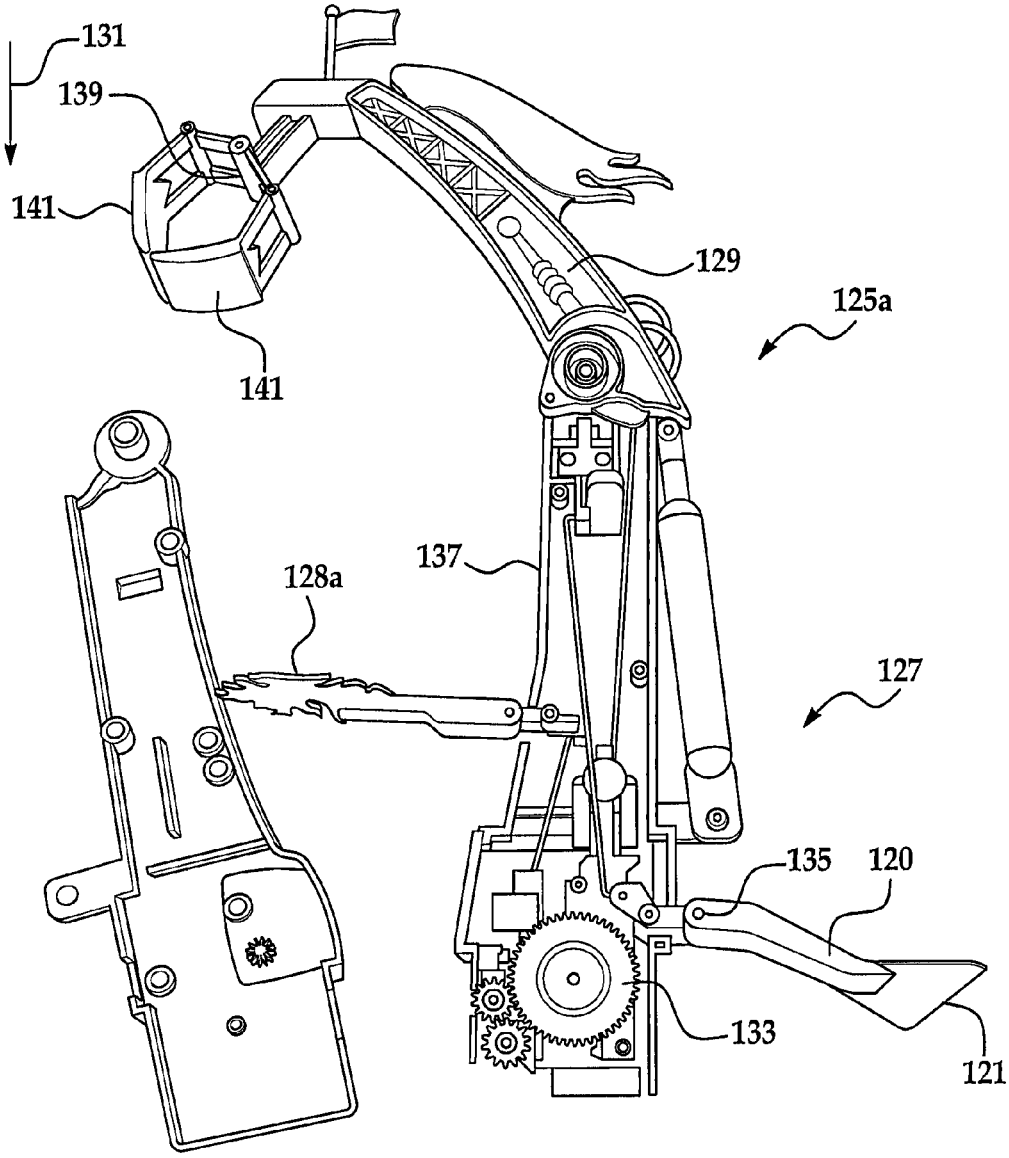
FIG. 1*c* shows an internal view of an example relay segment.

As shown in FIG. 1*b*, a crane relay segment 125*a* may include two triggers to perform a crane-based stunt. The first trigger may be a switch, such as a cone or other shaped actuation switch 120 at the end of an incoming track. A first vehicle may engage the first trigger and initiate release of a second vehicle which is held in the crane jaws. The vehicle released from the crane jaws 126*a* may fall and actuate a second trigger 128*a* to initiate the launch of a third vehicle onto an outgoing track. In addition, in some embodiments, the second trigger may also release a spring-loaded platform to knock off a stack of vehicles. The jaws of the crane, when fully closed, may hold the vehicle in a ready-to-be-released position. FIG. 1*c* further illustrates the mechanics of an example crane relay segment 125*a*.

FIG. 1*c* illustrates a mechanism 127 for performing the affirmation two trigger event. In one embodiment an upper portion 129 of the crane is moved downward in the direction of arrow 131 wherein a plurality of gears 133 are rotated and potential energy is stored in a spring mechanism that is wound as the gears are rotated and a pawl or catch mechanism engages the gears to prevent back driving of the gears by this spring mechanism, wherein the pawl or catch mechanism is released from the engaging position when a conical surface 121 of trigger 120 is engaged thus causing the same to pivot about a pivot point 135 with respect to a lower portion 137 of the crane. Once the kinetic energy of the spring mechanism is released the gear train causes the upper portion of the crane to move upward in a direction opposite to arrow 131 which also causes a clasp 139 to release a pair of claw members 141 from their grasping position illustrated in FIG. 1*c* to the open position illustrated in FIG. 1, wherein a car 124 is dropped and second trigger 128*a* is activated again releasing stored potential energy to cause another stunt to occur for example the flipping of the toy vehicles illustrated in FIG. 1. Clasp 139 may be any suitable arrangement comprising a hook of one of the claw members configured to engage a member of the other one of the claw members to retain the claw members in the position illustrated in FIG. 1*c* and thus allowing them to open to the position illustrated in FIG. 1 when the upper portion crane is moved upwardly such that the vehicle retained in the claw members is now above trigger 128*a*.

Referring again to FIG. 1, following activation of relay segment 110, and release of vehicle 124 onto target 128, launching element 132 and opening shelf 134 may be actuated. Specifically, launching element 132 may launch vehicle 140 along track 142, while opening shelf 134 throwing vehicles 136 and 138. Vehicle 140 may be propelled toward a third relay segment, such as relay segment 112.

Vehicle 140 may actuate a trigger in relay segment 112. The relay segment 112 may actuate launching element 150 to launch a third vehicle 146 toward relay segment 114. In some embodiments, track events may be terminated at trigger 148. However, in other events, another relay segment, stunt element, or obstacle may be added to the track such that the track does not terminate at trigger 148.

It should be appreciated that each relay segment may be selectively positioned in the track chain. As an example, relay segment 110 may be at the beginning, middle or end of the track. Similarly, relay segments 112 and 114 may be positioned at the beginning, middle or end of the track. A user may be able to customize the track by positioning the relay segments in a desired order.

It should be appreciated that the track play of each relay segment may be activated directly or indirectly by actuation of the trigger. As an example of indirect activation, the relay segment may include a stunt element performed by either the first or second vehicle. Further, the stunt element may be performed by a third vehicle. Further still, the stunt element may include multiple simultaneous, parallel, and/or sequential stunts performed by a plurality of vehicles, where the stunts may be performed simultaneously, in sequence with one triggering the next, in parallel, or combinations thereof. In still another embodiment, the launching element and/or the trigger may also include stunt elements performed by one of the first and second, or other vehicles. Although described in regards to actuation of the stunt elements via vehicle triggering, alternatively, track play may commence via manual activation of any of the relay segments or stunt elements. While FIG. 1 shows various example relay segments with multiple stage stunts, as well as without stunts, numerous variations in relay elements are possible.

Although shown with regard to a single straight-line track, it should be understood that virtually any number of different track designs may be used without departing from the scope of this disclosure. For example, parallel track configurations may be used, as well as combination sequential/parallel track configurations may be used. Further, various stunts may be performed, rather than the drops and/or loops shown, such as jumping over voids, traversing obstacles, etc.

Figure 2:
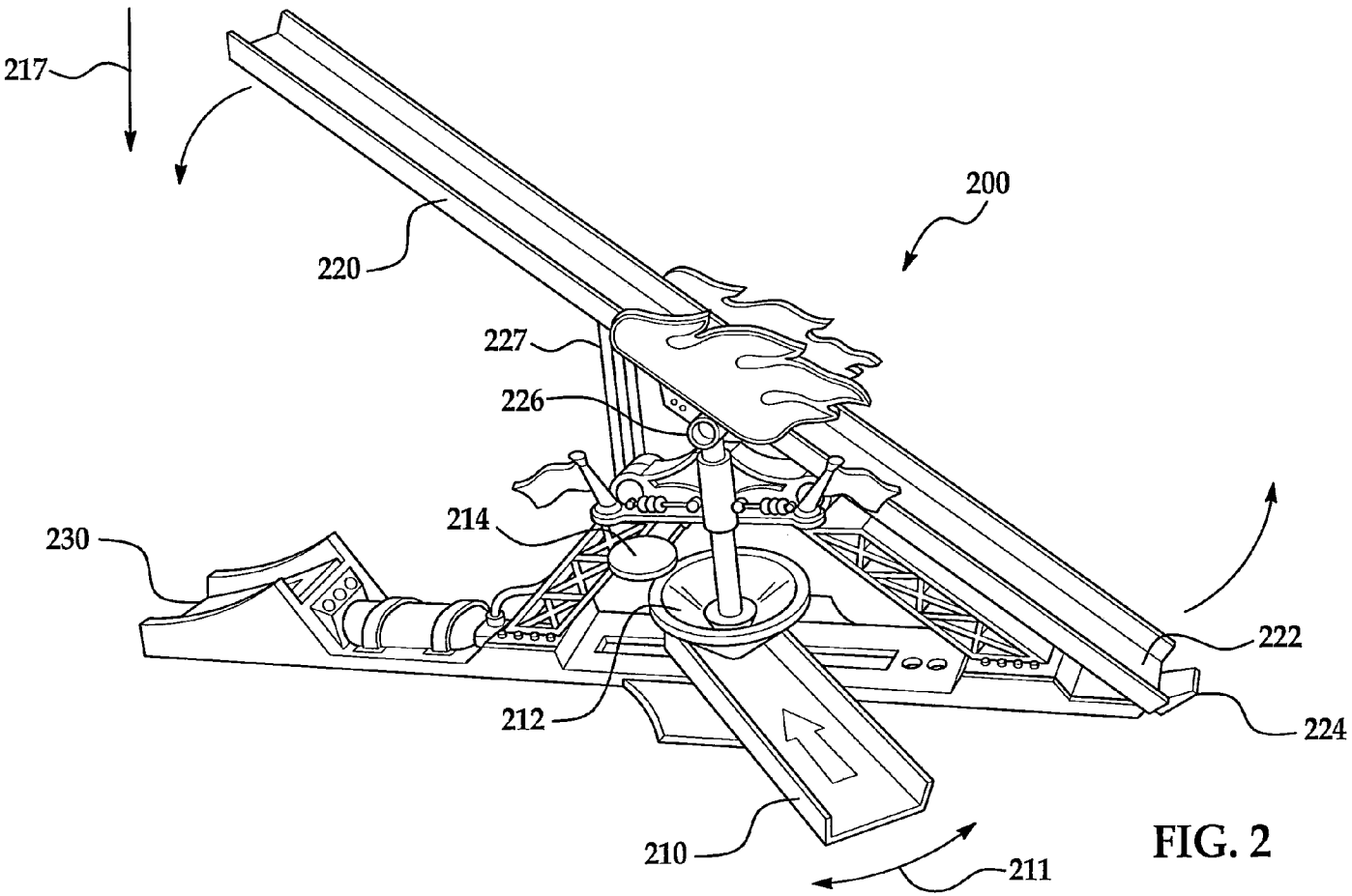
FIGS. 2-11 show example relay segments.

FIG. 2 shows an example relay segment 200 having a teeter-totter styled stunt element to provide indirect launching via automatic and/or manual trigger activation. Specifically, FIG. 2 shows an incoming track section 210 coupled to a conical trigger 212, which can also be actuated via the manual button 214. In this example, the trigger retains the ramp 220 in spring loaded position when the trigger or conical surface 212 thereof is in a downward position, such that contact by an incoming vehicle on track 210 causes the trigger to move vertically, release a catch that then releases spring loaded motion of ramp 220. For example, a vehicle may be pre-loaded at end 222 and held in place by stop 224. Then, upon release, the ramp 220 may rotate about pivot 226 as shown to launch a vehicle stored at 222. The vehicle may then exit the relay segment through exiting track section 230. In accordance with an exemplary embodiment of the present invention, the higher end ramp is pulled downward in the direction of arrow 217 to an urging force provided by a spring biased member or elastic member 227 thus causing the ramp 220 to pivot about pivot 226. The retention of the ramp in the illustrated position with the biasing member 227 extended it is facilitated by a catch that will engage a complementary member of the trigger which is moved out of its retaining position when the conical portion or the manual portion that of the trigger is moved thus releasing the stored potential energy of the elastic member.

While not shown in this example, the exiting track section 230 may be coupled to further track sections that may lead to additional relays segments, for example. Also, incoming track section 210 may be adjustable (e.g., rotatable or pivotally mounted to the relay segment for movement in the direction of arrows 211) to enable an incoming vehicle to enter the relay segment from a plurality of angles. Further, incoming track section 210 may be coupled to track segment that may be mounted to a higher altitude position, such that gravity may "launch" the incoming vehicle. Likewise, exiting track section 230 may also be adjustable.

Figure 3:
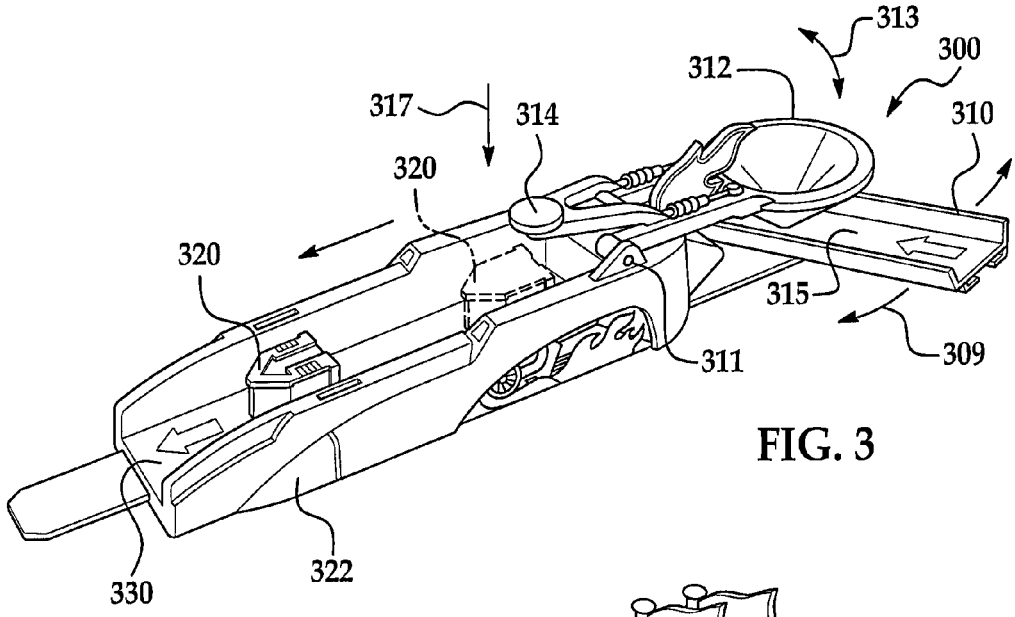
Figure 3A:
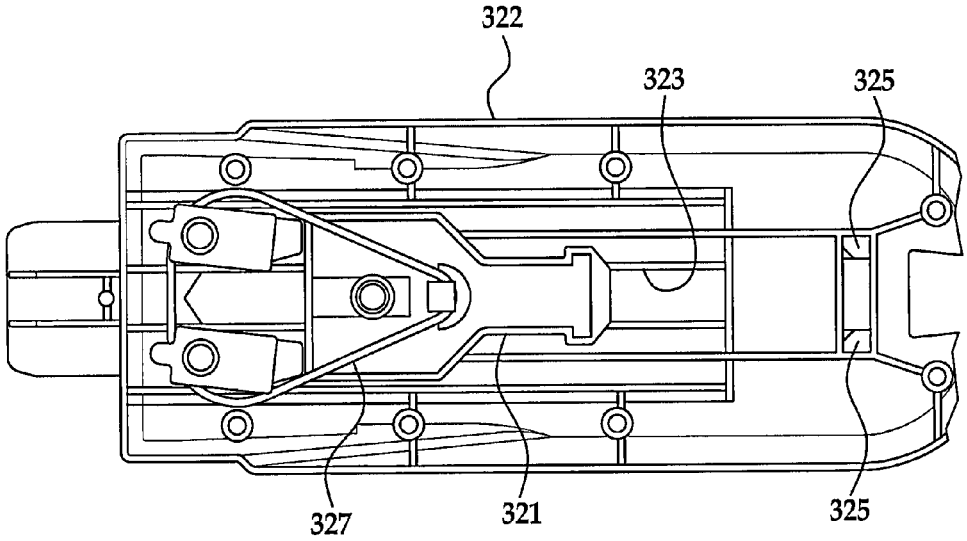
Figure 3B:
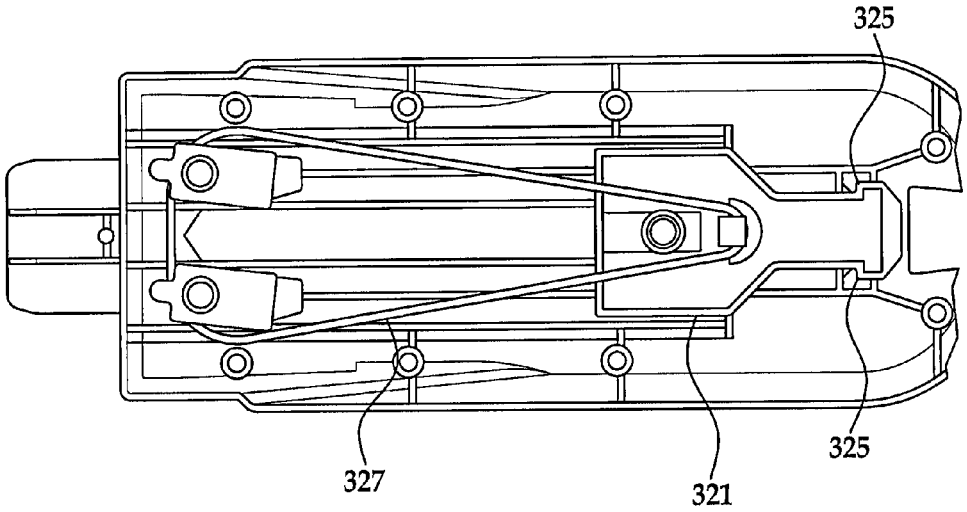

FIGS. 3-3B illustrate an exemplary direct acting relay segment 300. Specifically, FIG. 3 shows an incoming track section 310 coupled to the segment proximate to a conical trigger 312, which can also be actuated via the manual button 314. In this example, the trigger locks a launcher in a loaded position when the launcher is moved to a launch position and the trigger is in the position illustrated in FIG. 3. The trigger releases the stored energy of the launcher when a contact portion of the trigger is moved upwardly to release a catch retaining the launcher in the launch position. In one exemplary embodiment contact of the conical surface of the trigger by an incoming vehicle on track 310 causes the trigger to move vertically, release a catch that is retaining the launcher in the launch position. As illustrated in FIG. 3 a spring loaded launcher or protrusion 320 slides between a launched position (illustrated by the solid lines in FIG. 3) and a launch position (illustrated by the dashed lines in FIG. 3) in launcher 322. Accordingly, and as the launcher slides from the launch position to the launched position a toy vehicle in launcher 322 is pushed out of the relay segment. For example, a vehicle may be pre-loaded in launcher 322 until activation. Then, the vehicle may then exit the relay segment through exiting track section 330.

In this example, the trigger is pivotally mounted to the launching stunt element via pins 311 for movement between a first position and a second position in the direction illustrated by arrows 313, wherein movement of trigger from the first position (illustrated) to the second position (not-illustrated) occurs when a vehicle moves into an area 315 between a contact surface of conical trigger 312 and incoming track segment 310 thus forcing the conical trigger upward and away from track segment 310.

In addition, and in order to provide manual activation of the trigger (i.e., to begin a series of triggering events by launching the first car from a relay segment or a plurality of users can individually launch a car from separate relay segments or any combination thereof) a manual switch 314 is also secured to the trigger such that an application of a force in the direction of arrow 317 will cause the trigger to pivot about pivot pins 311 and move the contact surface of the conical portion away from the track segment 310 and dust release the launcher from its launch position.

Referring now to FIGS. 3*a*-3*b*, a bottom portion of launcher 322 is illustrated. Here a bottom portion 321 of the launcher 320 slides within a slot 323 of the launcher in order to effect movement from the launch position to the launched position. In accordance with one exemplary embodiment of the present invention a catch 325 secures and retains a portion of bottom portion 321 as it slid into the launch position. In order to provide the biasing force for urging the launcher from the launch position to the launched position a biasing element 327 is secured to the launcher and bottom portion 321. In accordance with an exemplary embodiment of the present invention, the biasing element is an elastic member. Of course, it is understood that any biasing element can be used, non-limiting examples include springs, resilient members and equivalents thereof. In addition, it is also understood that any suitable configuration may be provided for the catch and the bottom portion. In an exemplary embodiment and as the trigger or the conical portion of the trigger moves away from the track segment 310 catch 325, which is secured to the trigger and any suitable manner moves away from its retaining position illustrated in FIG. 3*b* and allows the elastic member to slide the launcher from the launch position to be launched position thus propelling a toy vehicle out of launcher 322. It is, of course, understood that the aforementioned description of the movement of the trigger and release of a biasing member is provided as an example and the exemplary embodiments of the present invention are not intended to be limited to the specific embodiment disclosed above. Similarly, exemplary embodiments of the present invention are not limited to launcher described above. For example, other releasable spring biased or otherwise type of toy launchers are found in U.S. Pat. Nos. 4,108,437 and 6,435,929 and U.S. Patent Publication 2007/0293122 as well as those known to those skilled in the related arts.

It should be noted that exiting track sections of each of the relay segments, such as exiting track section 330, may be coupled to further track sections that may lead to additional relays segments. The relay segments may be interchanged such that the track is customized. Also, incoming track sections of the relay segments, such as incoming track section 310, may be adjustable (e.g., rotatably or pivotally mounted to the relay segment for movement in the direction of arrows 309) relative to exiting track section 330 to enable an incoming vehicle to enter the relay segment from a plurality of angles and/or an exiting vehicle to exit the relay segment at a plurality of angles. It being understood that the exiting track section of each relay segment can be coupled to a movable incoming track section of another relay segment via connector track sections releasably secured to each track section via a releasable engagement mechanisms such as a tongue and groove arrangement. Accordingly, and through the use of movable incoming track segment's multiple angles and orientations are capable of being provided by the vehicle tracks set wherein multiple relay segments of installed therein.

Figure 4:
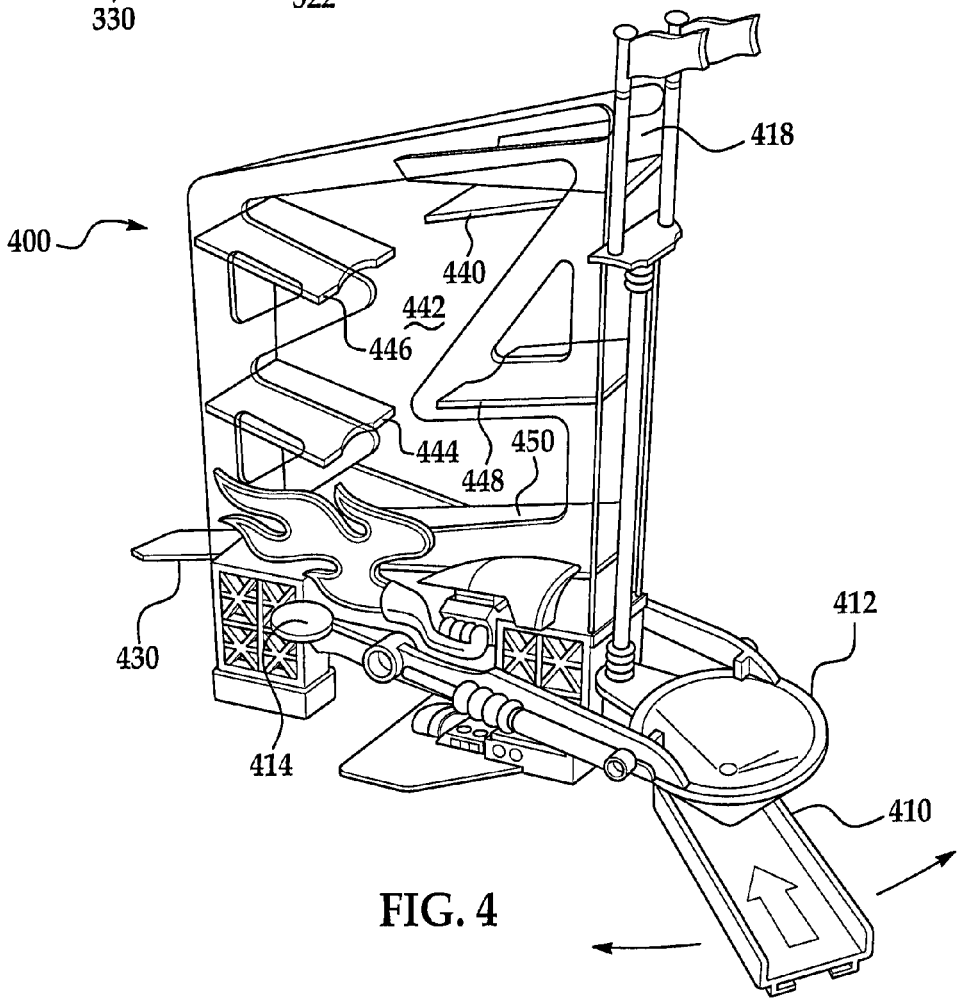

FIG. 4 shows an example indirect acting relay segment 400 having a gravity actuated intermediate falling stunt path. Specifically, FIG. 4 shows an incoming track section 410 coupled to a conical trigger 412, which can also be actuated via the manual button 414. In this example, the trigger may be spring loaded in a downward position, such that contact by an incoming vehicle on track 410 causes the trigger to move vertically, and push a vehicle positioned at the end section 418 to begin the falling stunt. As the vehicle is moves down ramp 440, it falls through the void 442 and may intermittently contact other track sections (e.g., 444, 446, 448) before landing on track 450. If the vehicle successfully lands on track 450, gravity moves the vehicle to be launched and it exits the relay segment through exiting track section 430.

Figure 5:
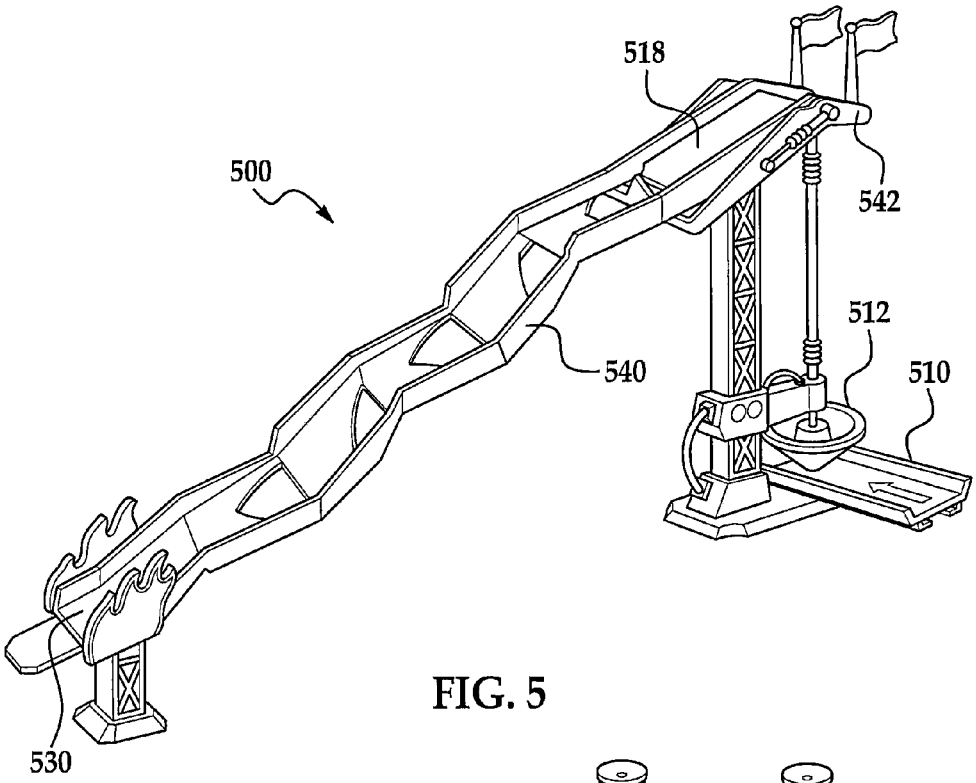

FIG. 5 shows an example indirect acting relay segment 500 having a gravity actuated zig-zag ramp stunt. Specifically, FIG. 5 shows an incoming track section 510 coupled to a conical trigger 512. In this example, the trigger may be spring loaded in a downward position, such that contact by an incoming vehicle on track 510 causes the trigger to move vertically, and push a vehicle positioned at the end section 518 to initiate movement down ramp 540, such as via rotation by platform 542. As the vehicle is moves down ramp 540, if successful, it is launched and exits the relay segment through exiting track section 530.

Figure 6:
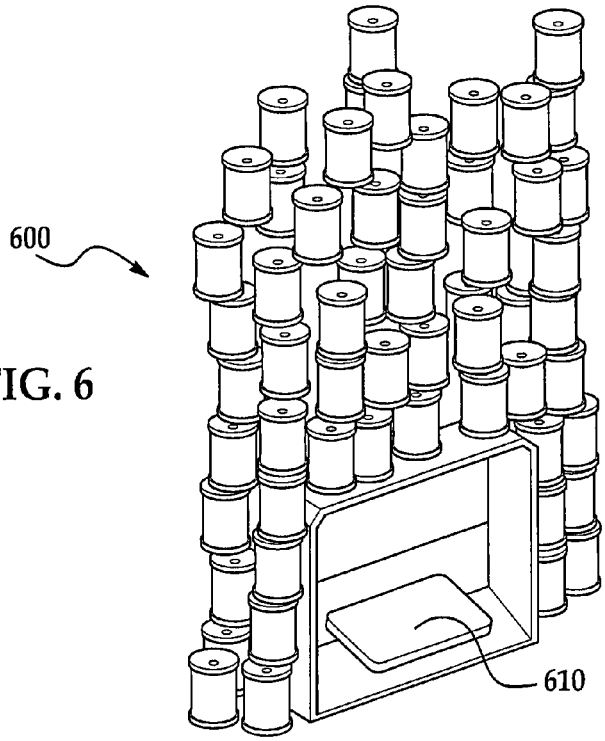

FIG. 6 shows an example relay segment 600 which may be selectively positioned along the track. As an example, the relay segment may include a track receiver 602 such that the track 604 lays into a groove 603 of the relay segment 600 in contrast to sliding male/female connector. A trigger or actuator 605 may be included to effect a stunt. For example, in the illustrated embodiment, activation of the lever (via contact with a traveling toy vehicle on the track) may cause the top of the silo to launched upward to simulate an explosion.

Figure 7:
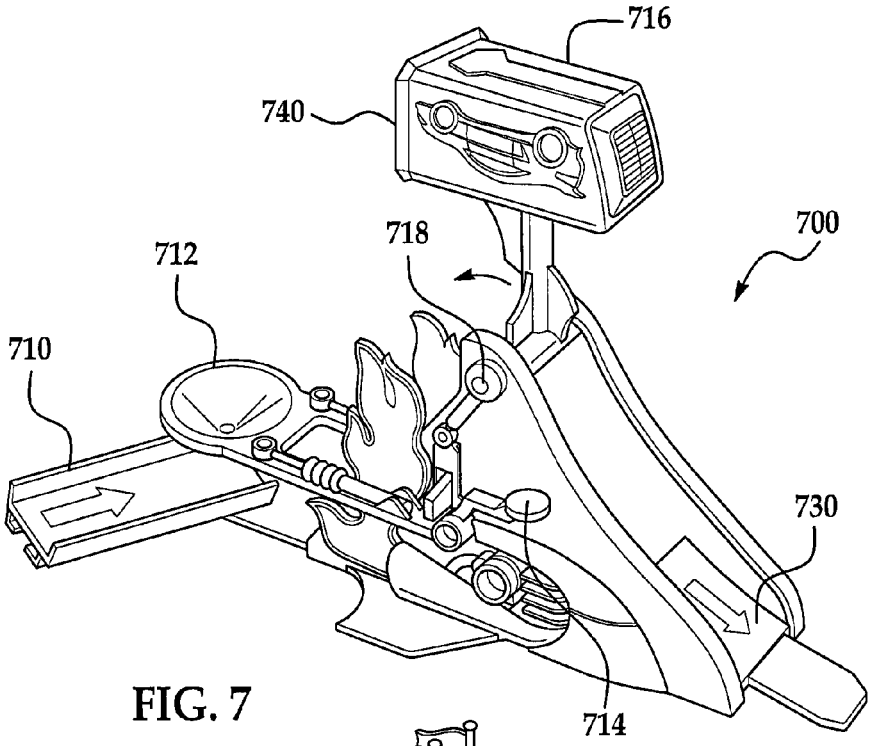

FIG. 7 shows an example indirect acting relay segment 700 having a gravity actuated hammer launch stunt. Specifically, FIG. 7 shows an incoming track section 710 coupled to a conical trigger 712, which can also be actuated via the manual button 714. In this example, the trigger may be spring loaded in a downward position, such that contact by an incoming vehicle on track 710 causes the trigger to move vertically, and initiate rotation of hammer box 716 about axis 718. A vehicle may be pre-loaded and positioned within hammer box 716 (which is open at end 740, not shown) such that upon swinging downward and stopping in the horizontal position, momentum is imparted to a vehicle that is launched out and/or down exiting track section 730, which may serve as a stop to stop rotation of hammer box 716.

While not shown in this example, the exiting track section 730 may be coupled to further track sections that may lead to additional relays segments, for example. Also, incoming track section 710 may be adjustable (e.g., rotatable) relative to exiting track section 730 to enable an incoming vehicle to enter the relay segment from a plurality of angles and/or an exiting vehicle to exit the relay segment at a plurality of angles.

Figure 8:
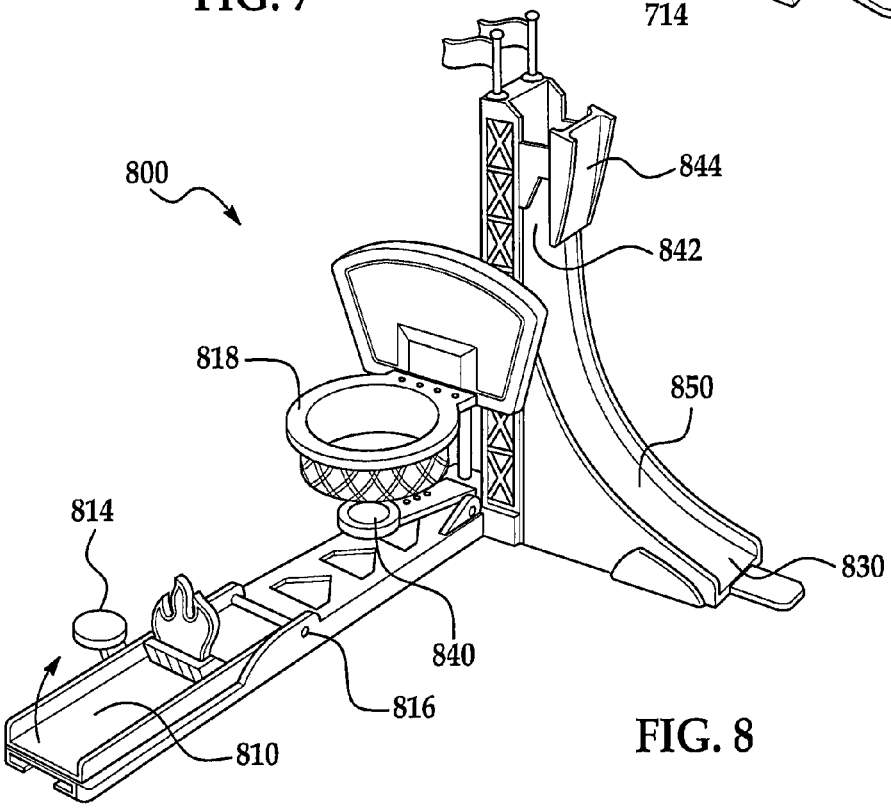

FIG. 8 shows two relay segments 800, including a basketball hoop stunt 802 and a ramp stunt/launcher stunt 804. The relay segments may be positioned in any order on the track. Specifically, basketball hoop stunt 802 includes a spring-loaded platform 810 on which a vehicle may pre-loaded. Upon actuation of the manual button 814, spring-loaded platform 810 rotates about axis 816 and if a vehicle passes through hoop 818, it may actuate a secondary trigger 840.

Another basketball hoop stunt 800*a* is shown in FIG. 8*a*. The relay segment may be configured such that an incoming vehicle is flipped up (e.g., via a spring loaded plate) toward a hoop, and if the vehicle lands in the hoop, a second actuator is triggered to launch a second vehicle in the same or alternative direction as the travel of the first, incoming vehicle.

Similarly, ramp stunt/launcher stunt 804, may be triggered such that, a vehicle, pre-loaded at the top 842 of ramp 850, and held by catch 844, is released (by movement of catch 844) to launch the vehicle out and/or down exiting track section 830, which may actuate or terminate another device, such as rotation of hammer box 716.

Figure 9:
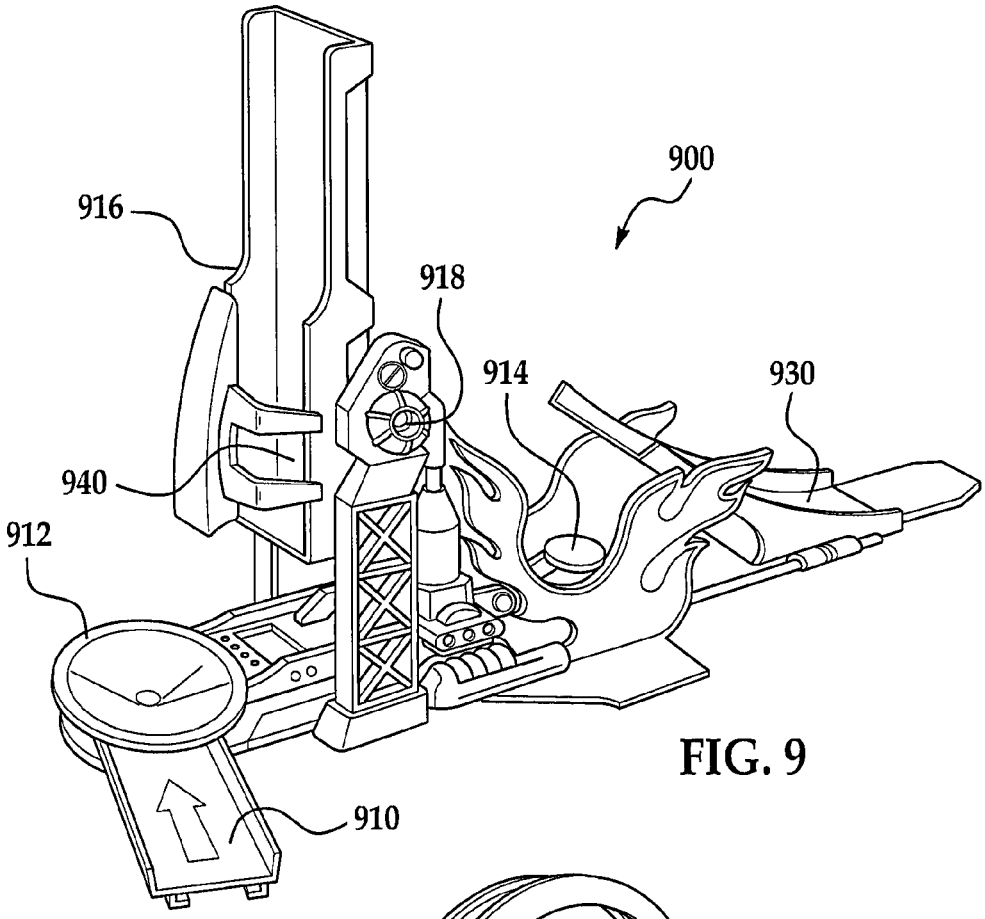

FIG. 9 shows an example indirect acting relay segment 900 having a gravity actuated rotating ramp launch stunt. Specifically, FIG. 9 shows an incoming track section 910 coupled to a conical trigger 912, which can also be actuated via the manual button 914. In this example, the trigger may be spring loaded in a downward position, such that contact by an incoming vehicle on track 910 causes the trigger to move vertically, and initiate rotation of rotating ramp 916 about axis 918. A vehicle may be pre-loaded and positioned within rotating ramp 916 at end 940 such that upon swinging downward and stopping in the downward position, a vehicle is launched down exiting track section 930. In this example, exiting track section 930 is sloped to further increase exiting speed of an exiting vehicle.

While not shown in this example, the exiting track section 930 may be coupled to further track sections that may lead to additional relays segments, for example. Likewise, in this or other examples the incoming track section may be coupled to other relays/stunts via still further track sections. Also, incoming track section 910 may be adjustable (e.g., rotatable) relative to exiting track section 930 to enable an incoming vehicle to enter the relay segment from a plurality of angles and/or an exiting vehicle to exit the relay segment at a plurality of angles.

Figure 10:
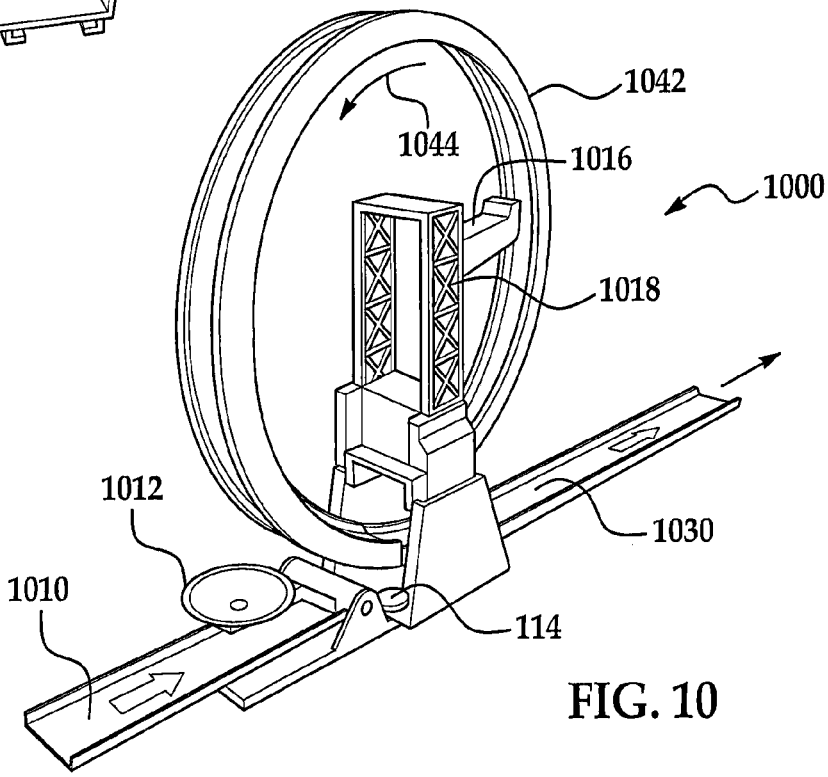
Figure 10A:
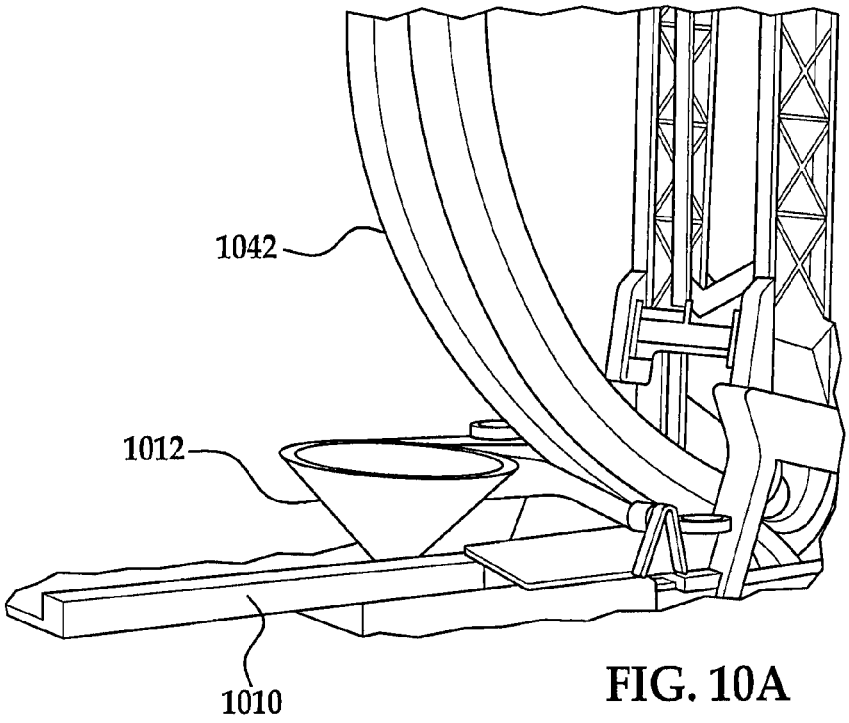
Figure 10B:
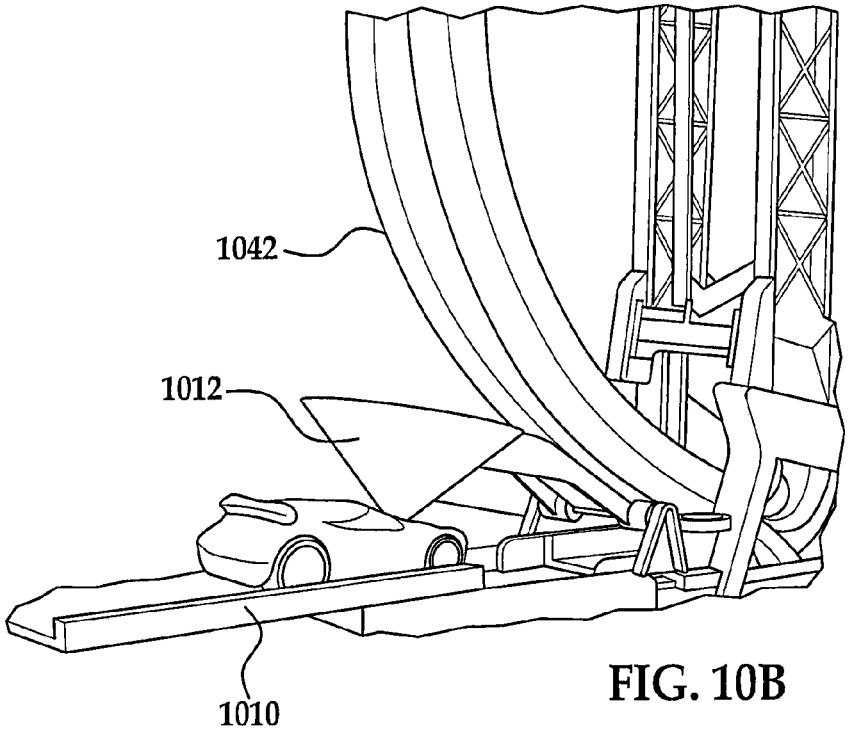

FIG. 10 shows an example indirect acting relay segment 1000 having a loop and launch stunt. Specifically, FIG. 10 shows an incoming track section 1010 coupled to a conical trigger 1012, which can also be actuated via the manual button 1014. In this example, the trigger may be spring loaded in a downward position, such that contact by an incoming vehicle on track 1010 causes the trigger to move vertically and release a catch holding spring loaded launching arm 1016 (note that in FIG. 10, spring loaded launching arm 116 is shown in the fully released state, whereas it is positioned vertically/downward in its pre-loaded state) so that it can rotate about axis 1018 and launch a vehicle pre-loaded at position, generally indicated at 1040. Upon launch, the pre-loaded vehicle travels through the loop track stunt 1042 and is launched out exiting track section 1030. Arrow 1044 indicates the direction of vehicle motion through the loop track stunt 1042. FIG. 10*a* shows the conical trigger 1012 in a first position while FIG. 10*b*. shows the conical trigger in a second position as it is moved up by the toy vehicle and in accordance with an exemplary embodiment of the present invention the trigger releases a launching element for launching a vehicle from the relay segment when the trigger is moved from the first position to the second position.

Figure 11:
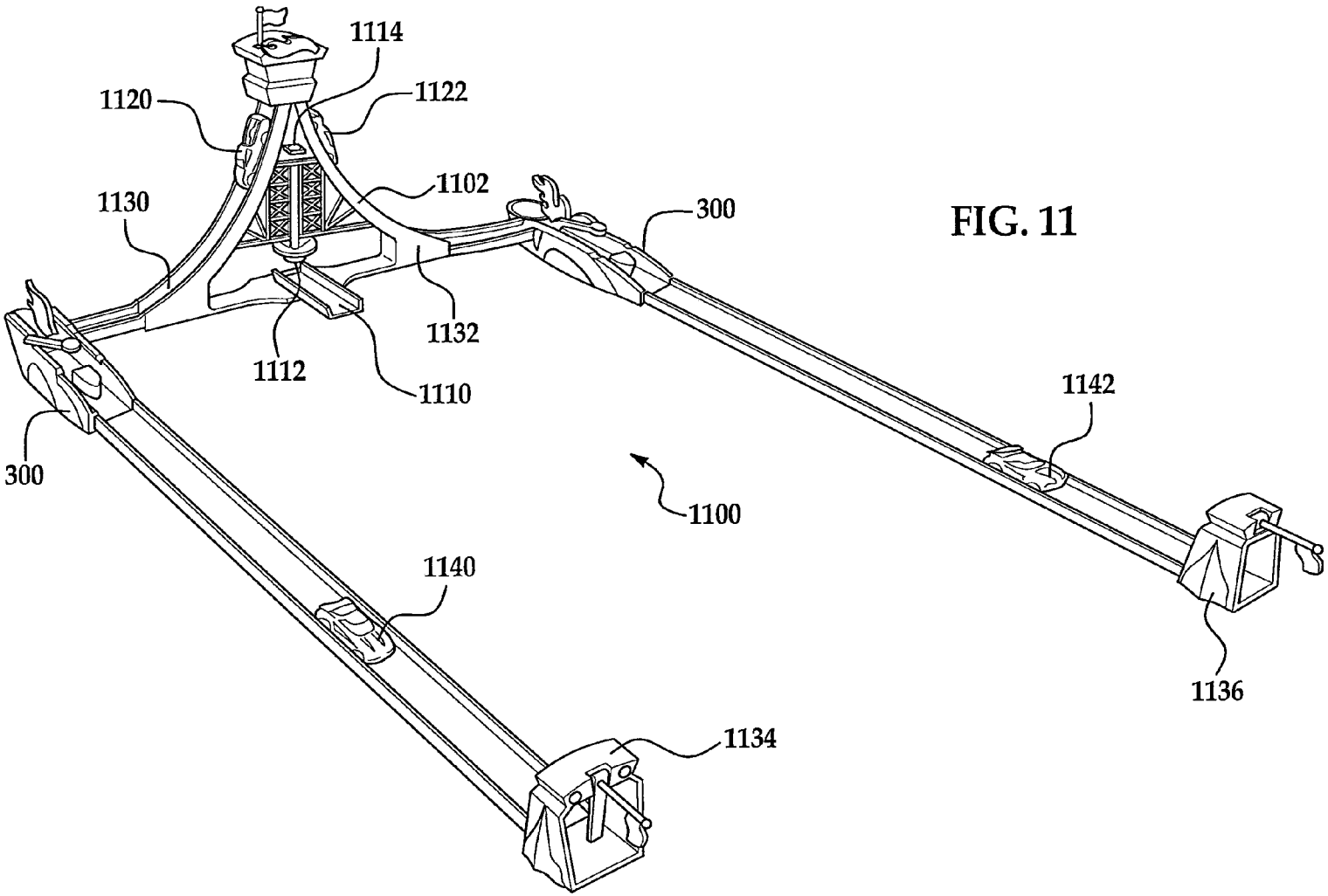

FIG. 11 shows still another track set example, in which motion of a single vehicle may initiate a plurality of vehicles through a plurality of relay segments positioned in parallel configuration. Specifically, as shown in FIG. 11, track set 1100 is shown having a first relay segment 1102 including a dual-action vehicle stunt. Specifically, first relay segment 1102 includes incoming track section 1110 coupled to a conical trigger 1112, which can also be actuated via the manual button 1114. In this example, the trigger may be spring loaded in a downward position, such that contact by an incoming vehicle on track 1110 causes it to move vertically and release a catch holding first and second preloaded vehicles 1120 and 1122, substantially concurrently. Alternatively, the vehicles may be released sequentially. For example, the release of one vehicle may be delayed relative to release of another vehicle.

Continuing with FIG. 11, relay segment 1102 includes a first and second ramp 1101, 1103 leading in different (e.g., opposite) directions, such that vehicles 1120 and 1122 may be launched by gravity to first and second exiting track sections, respectively. Further, track set 1100 may include two direct acting relays, such as relay 300, and finishing flag sections 1134 and 1136. As shown in FIG. 11, relays 300 may be positioned coupled to exiting track sections 1130 and 1132 and finishing flag sections 1134 and 1136 via various track segments. Further, as noted herein, vehicles may be preloaded into the two relays 300 (e.g., 1140 and 1142), which can be launched via actuation of vehicles 1130 and 1132, respectively. In this way, a sequential/parallel race configuration can be formed.

Figure 12:
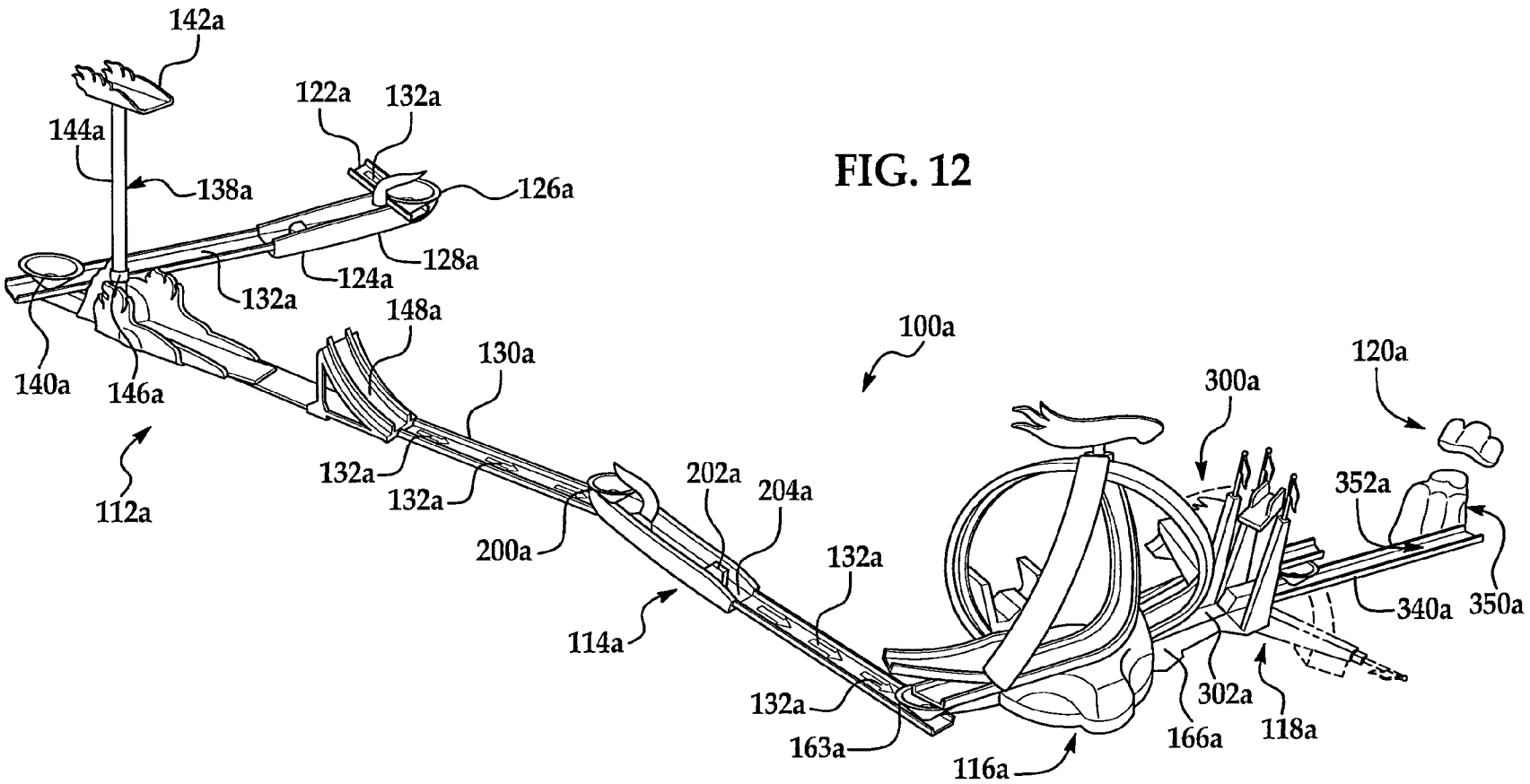
FIG. 12 shows another example toy vehicle track set including a plurality of relay segments.

FIG. 12 further illustrates a relay segment configured as a twin tower stunt element 1200. As an example, in the twin tower stunt element, a single input triggering event may cause simultaneously release of two vehicles moving in opposite directions propelled by gravity. It should be appreciated that a manual trigger may be included in each of the relay segments, including the twin tower stunt element, so that the relay segments may be the first stunt in the series. Moreover, in some large relay segments, there may be two or more manual triggers, such as on the front and back side of the element. For example, in the twin tower stunt element as illustrated there is a front manual activation switch. In some embodiments, there may be a similar activation switch on the back of the stunt element.

FIG. 12 illustrates yet another customizable track set. As with the previous embodiments, the track set may include a plurality of interchangeable relay segments which may be coupled to create a customized expandable track set, wherein the relay segments may include one or more stunt elements and may be selectively positioned at the beginning, middle, or end of the track. In some embodiments, the relay segments may be configured to enable a first toy vehicle to trigger a second toy vehicle to traverse an obstacle or perform a stunt. Further in some embodiments, a relay segment exit vehicle may be released to travel a subsequent relay segment.

It should be appreciated that the track sets described herein may be used for toy vehicles. As an example, the toy vehicles may be 1:64 scale models, however other sized toy vehicles may be also used. One exemplary range would be 1:50 scale of less, again it is, of course, understood that scales greater or less than 1:50 are contemplated to be within the scope of exemplary embodiments of the present invention.

A toy vehicle track set 100*a* having multiple relay segments 110*a*, 112*a*, 114*a*, 116*a*, 118*a* and 120*a* is shown in FIG. 12. As discussed in more detail below, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

In this example, each relay segment 110*a*, 112*a*, and 114*a* may include an incoming vehicle trigger which may directly or indirectly causes the launching of another outgoing vehicle, also referred to herein as a relay segment exit vehicle. As an example, each relay segment may include an incoming track, such as incoming track 122*a*, for an incoming vehicle, and an exit track, such as exit track 124*a*, for an outgoing vehicle. The exit track of one relay segment may be interchangeably coupled with the incoming track of a second relay segment such that the outgoing vehicle from one relay segment may become the incoming vehicle of a next relay segment.

One or more launchers may be provided to accelerate toy vehicles along the track. As such, the launchers may be configured to engage and urge a toy vehicle to travel along the track. It should be appreciated that although launchers are described herein, vehicles may be manually propelled along the track without the use of a launcher without departing from the scope of the disclosure.

Although any suitable launcher may be used, in the illustrated embodiments, various automatically and manually-triggered release launcher elements are illustrated. A vehicle may be positioned in launch position such that a launch element may slidingly engage the vehicle to propel the vehicle along the track. The launch element may be biased to a launch position, such as by springs or any other suitable biasing mechanism such that release of an activator releases its stored potential energy.

In one example, the relay segments may include incoming vehicle triggers. The triggers may be configured to enable an incoming vehicle to actuate a stunt and release of an outgoing vehicle from the relay segment. The triggers may be positioned such that a vehicle traveling along the track actuates the trigger.

As one example, the vehicle triggers may be conical-shaped triggers (shown in FIG. 12 at 126*a*) or other shaped triggers. As an example, conical-shaped trigger 126*a* may have a cone angle of approximately 45 degrees, which may be actuated vertically via contact with a horizontally moving incoming vehicle. It should be appreciated that the cone angle may be of any suitable angle such that an incoming vehicle actuates the trigger. Thus, as a non-limiting example the cone angle may be anywhere from 5-90 degrees.

Further, while this example shows a conical trigger, alternatively, it may be planar shaped and angled (e.g., approximately 45 degrees) relative to an incoming track. As a further example, an example trigger may have a flat, angled plane formed by a plurality of ridges) that is configured to be contacted by a vehicle on a track. Again, although in one example the trigger may have an angle of approximately 45 degrees, any suitable angle may be applied (e.g. 5-90 degrees) such that a vehicle actuates the trigger. Further, the trigger may be engaged under or along the side of the track, such that the vehicle actuates the trigger by traveling over or through a portion of the track.

In some relay segments, actuation of a trigger by a first vehicle initiates a stunt and release of a second outgoing vehicle on the track set. In some embodiments, manual triggers may also be included, alone or in combination, with the vehicle triggers. Manual triggers may be configured to be actuated such that a stunt is initiated and/or an outgoing vehicle is released from the relay segment. The outgoing vehicle may travel to a second relay segment.

It should be appreciated that the track play of each relay segment may be activated directly or indirectly by actuation of a trigger. As an example of indirect activation, the relay segment may include a stunt element performed by either a first or second vehicle. Further, the stunt element may be performed by a third vehicle. Further still, the stunt element may include multiple simultaneous, parallel, and/or sequential stunts performed by a plurality of vehicles, where the stunts may be performed simultaneously, in sequence with one triggering the next, in parallel, or combinations thereof. In still another embodiment, the launching element and/or the trigger may also include stunt elements performed by one of the first and second, or other vehicles. Although described in regards to actuation of the stunt elements via vehicle triggering, alternatively, track play may commence via manual activation of any of the relay segments or stunt elements.

As an example and referring again to FIG. 12, in the configuration illustrated, track play may be commenced with stunt element or relay segment 110*a*. For example, actuation of manual release or manual trigger 102*a* may propel or launch a toy vehicle (not shown) along exit track 124*a* toward a second relay segment 112*a*. In one example embodiment, a relay segment may enable a variable change of vehicle traveling direction (between an incoming and outgoing vehicle), thus further providing variable configurations for more diverse track play.

It is noted that track connector sections, as shown for example at 130*a*, may be interposed between relay elements extending the distance between a first and second relay element. Thus, in addition to selective positioning of each relay segment, track connector sections may be selectively positioned to enable customization of the track since each of the incoming track sections they are releasably secured thereto are rotatably mounted to the relay segment.

One or more portions of the track set, such as the incoming track and exit track of the relay segments and/or the track connector segment may include direction indicators, shown at 132, such as molded-in arrows, or cut-outs which may indicate vehicle direction and/or assembly instructions for a toy track set. For example, the direction indicators may aid in the ease of assembly for an expandable track set, may provide specific direction of vehicle travel used to initiate stunts, or enable passage past obstacles. Although the direction indicators are shown as a row of cut-out arrows, it should be appreciated that the direction indicators may be of any size and/or shape to indicate assembly direction and/or vehicle travel direction. Further, although a plurality of arrows is illustrated, a single arrow or other cut-out may also be used without departing from the scope of the disclosure. Further, in some embodiments, the direction indicators may be positioned in a center of the track so that the wheels of the vehicles are not impeded. It further should be appreciated that although shown as cut-outs, the direction indicators may be surface indicators, raised moldings, etc. In an exemplary embodiment, the arrows are integrally molded with the track and/or relay segment.

For example, a vehicle released from relay segment 110*a* and traveling along track 130*a* in the direction of the direction indicators may contact or engage a second relay segment, e.g. relay segment 112*a*. As described in more detail below, each relay segment may actuate a stunt. Stunts may include one or more, as well as any combination of, loops, jumps, collisions, simulated explosions, vehicle crashes, vehicle drops, vehicle lifts, vehicle obstacles, vehicle spins and other vehicle obstacles. In some embodiments, stunt vehicles may be preloaded for release upon actuation of the relay segment trigger (e.g. actuation by an incoming vehicle of the vehicle trigger or manual actuation of a trigger).

For example, relay segment 110*a* may be a stunt element, such as a falling and pivoting ramp element 138*a*. Upon contact or actuation of trigger 140*a*, a falling and pivoting ramp stunt event may be initiated. A stunt vehicle (not shown) may be pre-positioned on platform 142*a*. In the falling and pivoting ramp stunt event, platform 142*a* may be rotatably coupled to arm 144*a* which may be pivotally coupled through pivot 146*a* to the relay segment. Upon actuation by an incoming vehicle, the arm 144*a* may swing from a first generally vertically-extended position (shown) to a second generally horizontally-extended position. Further, platform 142*a* may rotate such that the platform rotates to generally correspond to enable release of the stunt car down exit track 148*a*. As such, the pre-positioned vehicle may be released down exit track 148*a* toward the next relay segment, such as relay segment 114*a*.

Addition details illustrating an example falling and pivoting ramp element 112*a* are shown in FIG. 2. As shown, an incoming track 150*a* may enable an incoming vehicle to contact or actuate trigger 140*a*. Although shown as a conically-shaped trigger, it should be appreciated that the trigger may be any suitable, manual and/or vehicle, actuated switch. The incoming vehicle may be stopped at trigger 140*a*.

Actuation of trigger 140*a* may release arm 144*a* from a first position. The first position, as illustrated, is a substantially vertical position, where platform 142*a* is in a substantially parallel plane to the ground surface. Upon release of arm

144*a* from the first position, arm 144*a* pivots or swings about pivot point or hinge 146*a* such that the arm falls as indicated by arrow 152*a*. Further, in some embodiments, platform 142*a* may be rotatably coupled to arm 144*a* such that it may rotate as indicated at arrow 154*a*.

Figure 13:
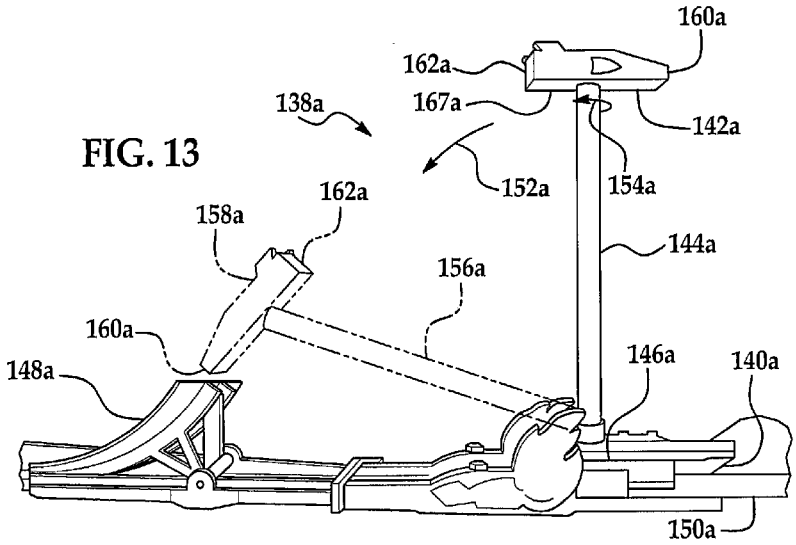
FIGS. 13-17 illustrate still other relay segments in accordance with exemplary embodiments of the present invention.

Release of arm 144*a* and rotation of platform 142*a*, results in the arm and platform moving to a vehicle release position indicated in dashed lines in FIG. 13. As shown at 156*a*, the arm may be substantially parallel to the ground surface such that platform 142*a* is substantially aligned with exit track 148*a*. Further, at 158*a*, the platform has rotated such that a front portion 160*a*, with an opening for vehicle release, is aligned with the exit platform 148*a*.

In one embodiment, the platform 142*a* includes a front portion 160*a* and a rear portion 162*a*. Rear portion may include a stop wall 164*a* to prevent a preloaded vehicle from prematurely releasing from the platform. Additional vehicle engagement features, such as detents may further retain the preloaded vehicle in the platform during the stunt. As discussed above, upon rotation of the platform, front portion 160*a* aligns with exit track 148*a*. The angle of the platform in the release position enables the vehicle to break away from the engagement features and travel down exit track 148*a* toward a subsequent relay segment.

In some embodiments, lock features may be provided to lock the arm in the first and second positions. Release structures may be further provided to enable a user to release the arm from the first and second positions. Further, although not shown in detail in regards to the falling and pivoting ramp element, the relay segments may be configured to fold into compact configurations to reduce packaging size and for ease of storage. Additional examples regarding relay segment folding are disclosed in more detail below.

Referring back to FIG. 12, following activation of relay segment 112*a*, and release of a preloaded vehicle from platform 142*a* onto exit track 148*a*, the preloaded vehicle is now an incoming vehicle for the next relay segment, such as relay segment 114*a*. Thus, although described in this example where activation of relay segment 112*a* results in subsequent release of a vehicle to activate relay segment 114*a*, other configurations are possible and contemplated. Thus, it should be appreciated that each relay segment may be selectively positioned in the track chain. As an example, relay segment 110*a* may be at the beginning, middle or end of the track. Similarly, relay segments 112*a*, 114*a*, 116*a*, 118*a*, 120*a* may be positioned at the beginning, middle or end of the track. A user may be able to customize the track by positioning the relay segments in a desired order or combination.

Relay segment 114*a* is an example of a direct acting relay segment. An incoming vehicle may actuate a trigger 200*a* which may effect release of a preloaded vehicle from launcher 202*a*. The preloaded vehicle may exit relay segment 114*a* toward relay segment 116*a* along exit track 204*a*.

Direct acting relay segment 114*a* is similar to the relay segment illustrated in FIG. 3 wherein a launching stunt element 300, including an incoming track 310 pivotally mounted thereto proximate to conical trigger 312, which can also be actuated via the manual button 314. In this example, the trigger is pivotally mounted to the launching stunt element via pins 311 for movement between a first position and a second position in the direction illustrated by arrows 313, wherein movement of trigger from the first position (illustrated) to the second position (not-illustrated) when a vehicle moves into an area 315 between conical trigger 312 and incoming track segment 310.

Movement of the conical trigger 312 again causes release of stored potential energy to move a launching member in a manner similar to that described with respect to FIGS. 3-3*c*, wherein contact by an incoming vehicle on track 310 causes the trigger to move vertically, release a catch that then releases spring loaded launcher protrusion 320 in launcher 322. For example, a vehicle may be pre-loaded in launcher 322 until activation. Then, the vehicle may then exit the relay segment through exiting track section 330.

It should be noted that exiting track sections of each of the relay segments, such as exiting track section 330, may be coupled to further track sections that may lead to additional relays segments. The relay segments may be interchanged such that the track is customized. Also, incoming track sections of the relay segments, such as incoming track section 310, may be adjustable (e.g., rotatable) relative to exiting track section 330 to enable an incoming vehicle to enter the relay segment from a plurality of angles and/or an exiting vehicle to exit the relay segment at a plurality of angles.

Referring back to FIG. 12, an outgoing vehicle from relay segment 114*a* is an incoming vehicle for relay segment 116*a*. Incoming vehicle travels along incoming track 163*a* to actuate trigger 164*a* of relay segment 116*a*. Relay segment 116*a* may be a stunt element, such as an exchanger stunt element or exchanger. The incoming vehicle initiates the stunt, following which a pre-loaded stunt vehicle performs the stunt and exits stunt at 166*a* toward the subsequent stunt 118*a*.

Figure 14:
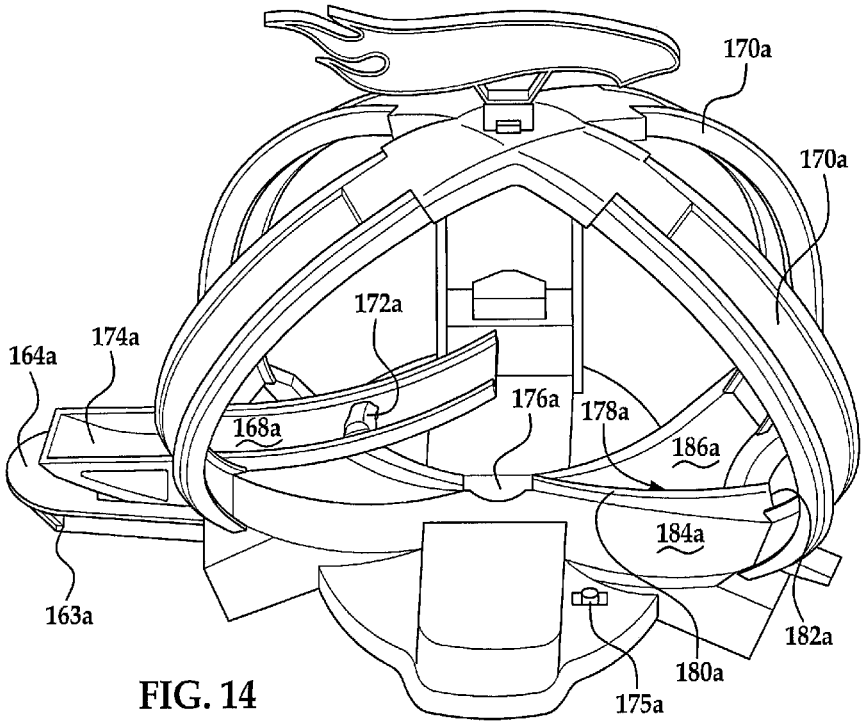

Specifically and as illustrated in FIG. 14 stunt element 161 is configured to provide a multiple loop stunt for a preloaded vehicle. As shown, incoming track 163*a* is pivotally mounted to the stunt element proximate to a conical trigger 164*a*. It should be appreciated that although shown as a conical trigger, the trigger may be any suitable shape such that a vehicle traveling on track 163*a* can activate the stunt. Further, in some embodiments, a manual trigger may also be provided. In this example, the trigger is spring loaded in a downward position, such that contact by an incoming vehicle on track 163*a* causes the trigger 164*a* to move vertically and release a catch that then releases a preloaded vehicle down ramp 168*a* into the exchanger loops 170*a*.

As illustrated, a preloaded vehicle may be positioned at the top of ramp 168*a* and held in launch position by stop 172*a*. Upon actuation of trigger 163*a*, stop 172*a* is released and the preloaded stunt vehicle launches down the ramp to direction changer 174*a* and then through booster 176*a*. Booster 176*a* may be any device to impart addition acceleration onto the toy vehicle. For example, booster 176*a* may be motorized wheels which further launch the vehicle into loops 170*a*. A switch 175*a* may be used to turn on the booster motor.

A directional key 178*a* directs the vehicle into alternative loops. For example, in the illustration, the direction key 178*a* has a path-defining section 180*a* which provides a rail edge defining the vehicle pathway and a contact switch 182*a* which upon contact with the vehicle as it travels along the defined pathway is flipped such that the key first defines a first pathway 184*a*, and upon contact with the vehicle defines a second pathway 186*a*. Each time the vehicle goes around the loop, the direction key is switched such that the vehicle alternatively travels the first pathway and then the second pathway.

In some embodiments, a timer may be used to time the vehicle's travel in loops 170*a*. For example, the vehicle may continue to travel in the loops for a predetermined period, such as a period of 5 seconds or any other preset time period. Following the predetermined period, the vehicle may be ejected from the loops. In other embodiments, the vehicle may perform a predetermined number of loops prior to ejection from the loops.

Ejection of the vehicle from loops 170*a* may occur after a predetermined event, a predetermined time, or in some embodiments, upon a user's activation. The vehicle may be ejected from exchanger stunt element 161*a*. For example, in some embodiments, completion of the predetermined event or time may actuate the directional indicator platform such that it raises up defining a vehicle ejection path.

Figure 15:
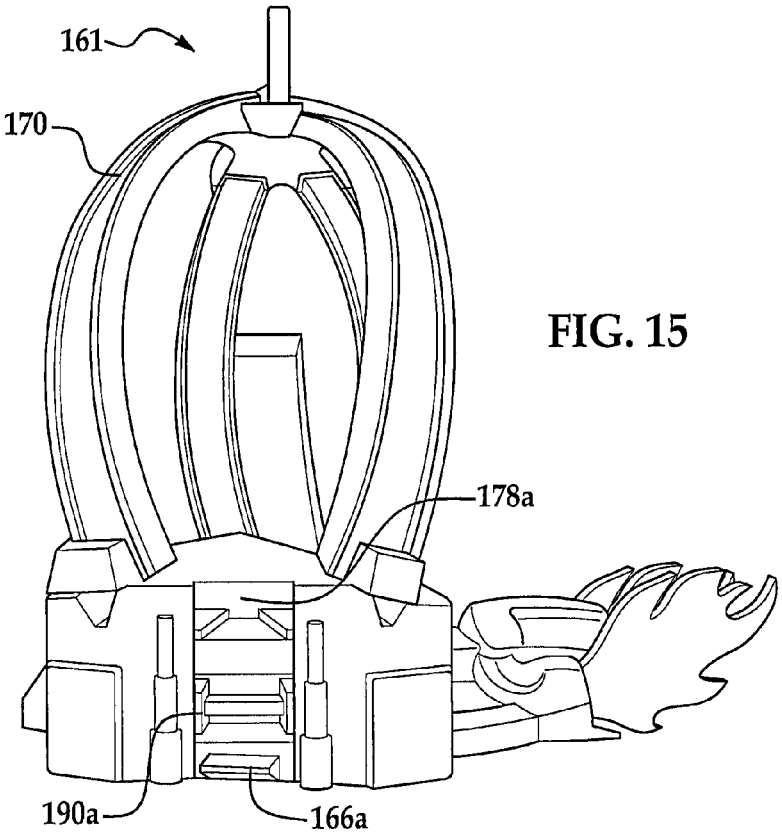

As shown in FIG. 15, a cavity 190*a* is provided under the directional indicator 178*a*. In some embodiments, following completion of the loop portion of the stunt, the directional indicator may move to allow the vehicle to follow a vehicle ejection path to exit track 166*a*. In other embodiments, completion of the loop portion of the stunt may trigger a preloaded stunt vehicle positioned in cavity 190*a* to be launched out along exit track 166*a*.

In such embodiments, the vehicle traveling the loops may be ejected from the loops such that the vehicle falls from the exchanger stunt element. For example, the directional indicator may block the traveling path and causes the vehicle to impinge against the tip of the directional indicator and be forced from the track. In some embodiments, additional switches or changes in the boosters may be provided to break the vehicle's travel path resulting in the vehicle being discharged from the loops.

Returning back to FIG. 12, the outgoing vehicle released from relay segment 116*a* along exit track 166*a* may travel to relay segment 118*a*. This outgoing vehicle of relay segment 116*a* is incoming vehicle for relay segment 118*a*. Relay segment 118*a* may be a stunt element, such as a tower stunt element. The incoming vehicle initiates the stunt, following which a pre-loaded stunt vehicle exits stunt element at 340*a* toward a subsequent relay segment.

Figure 16:
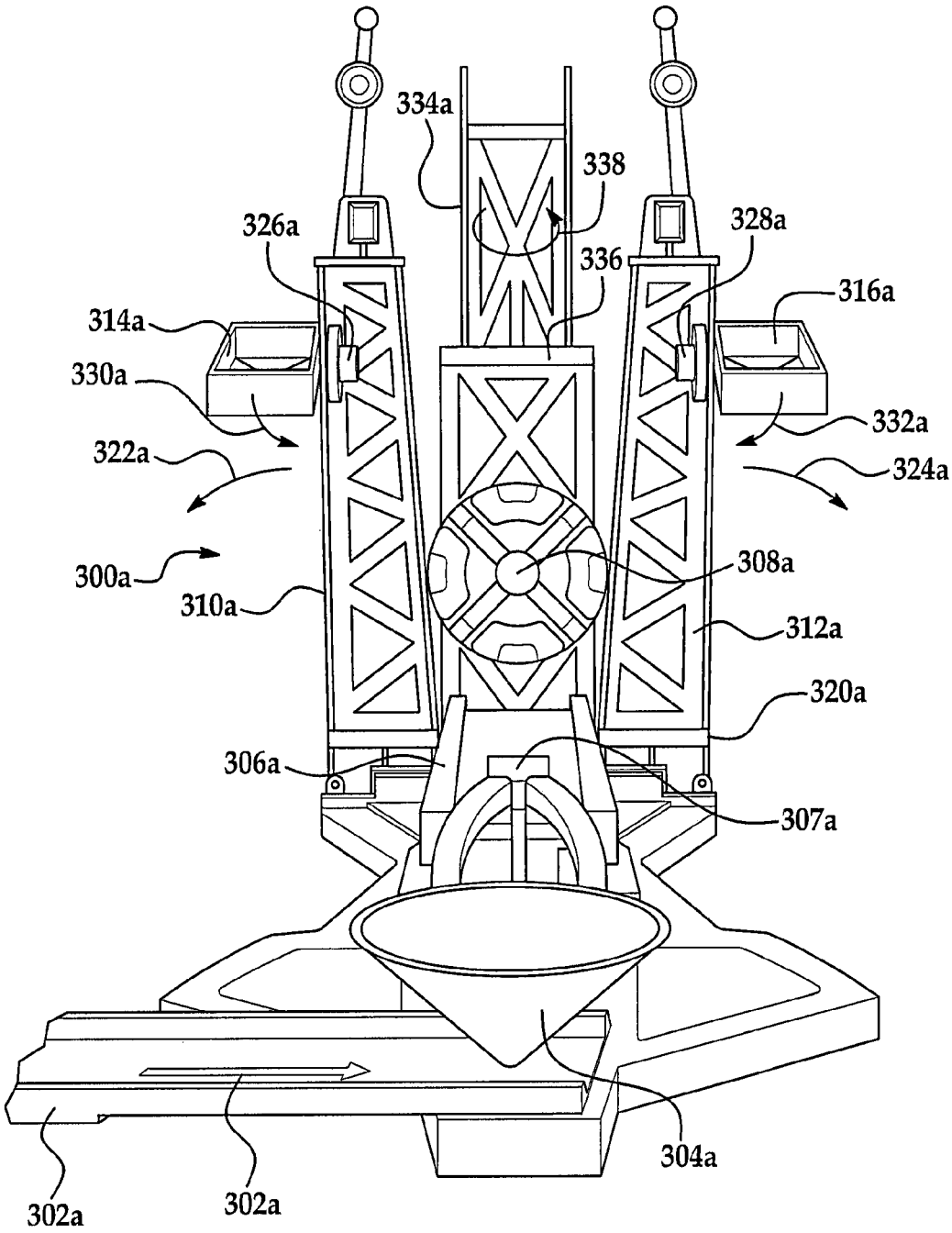

FIG. 16 illustrates an example tower stunt element 300*a* in more detail. As illustrated, tower stunt element 300*a* is configured to provide a multiple vehicle stunt. As shown, incoming track 302*a* is coupled to a conical trigger 304*a*, which can also be actuated via one or more manual buttons or actuators. Actuation of trigger 304*a* results in initiation of a tower stunt, including release of a plurality of preloaded vehicles from the tower. For example, the trigger may be spring loaded in a downward position, such that contact by an incoming vehicle on track 302*a* causes the trigger to move vertically and release a catch that then initiates a first part of the multiple stage vehicle stunt.

As an example, a first stunt vehicle may preloaded into launch cavity 306*a*, wherein cavity 306*a* includes a launching structure such as a spring-loaded launch slider 307*a* which upon activation, such as through trigger 304*a*, slides forward. Motion is imparted to the preloaded stunt vehicle such that the stunt vehicle launches towards a target, such as bulls eye 308*a*. Although shown as a bulls eye, any design configuration is possible for the target.

Additionally, additional stunt vehicles may be preloaded into the release boxes 314*a* and 316*a* on side towers 310*a* and 312*a* respectively. Impact on the target, such as bulls eye 308*a*, may actuate a second stunt stage. In the second stunt stage, side towers 310*a*, 312*a* may be released such that the towers 310*a*, 312*a* fall outwards about hinges 318*a* and 320*a* as indicated by arrow 322*a* and 324*a* respectively. The release boxes are rotatively coupled to the towers such that upon actuation of the second stunt stage the release boxes rotate from a storage position to a release position. The storage position may be any suitable position where a vehicle does not fall from the release boxes. Thus, in some embodiments, the storage position may be such that the release boxes are parallel to the ground surface. In other embodiments, the release boxes may be angled such that the vehicles are retained in the storage boxes.

Actuation of the second stunt stage effect the release boxes 314*a*, 316*a* to rotate about pivot points 326*a*, 328*a* as indicated by arrows 330*a*, 332*a*. In the release position, the release boxes are angled such that the preloaded stunt vehicles fall from the boxes. Further, towers 310*a* and 312*a* fall outward such that preloaded vehicles and the towers crash into the ground surface.

A third stunt stage may be activated upon completion of the second stunt stage. For example, rotation of the towers from the base may actuate a switch to initiate a third stunt stage. In the third stunt stage, a release box 334*a* may be preloaded with another stunt vehicle. The release box may be in a first position facing the incoming track 302*a* and trigger 304*a*. The release box may be rotatively coupled to the top of the tower for rotation about pivot point 336*a*. Upon actuation of the third stunt stage, the release box may rotate from the first position to a release position where the preloaded vehicle is released down exit track 340*a*. As such, in the release position, the release box rotates 180 degrees such that it faces exit track 340*a*. It is noted that a structural detent mechanism may be used to hold the vehicle in the first position. This detent mechanism may include structure such as the top surface of the tower which when in the first position prevents the vehicle from releasing. In other embodiments, a moveable gate or structure may be provided which prevents movement of the vehicle when in the first position but allows the preloaded vehicle to release when in the release position.

As such the tower stunt element may be considered a multi-stage stunt element. In this multi-stage stunt element, completion of each stage actuates a further stage. Specifically, in the illustrated embodiment, actuation of the multi-stage stunt element results in actuation of a first stage where a first preloaded vehicle impacts a target; completion of the target impact actuates a second stage where two preloaded vehicles are released and two towers fall outward toward a ground surface; completion of the tower fall actuates a third stage where a fourth preloaded vehicles is launched down exit track 340*a*. This vehicle is the outgoing vehicle of the tower stunt element and becomes the incoming vehicle for the subsequent stunt.

Again referring back to FIG. 12, the vehicle released from relay segment 118*a* traveling along exit track 340*a* may further engage a relay segment element 120*a*. In one embodiment, relay segment element 120*a* is a single vehicle stunt element where the incoming vehicle is the outgoing vehicle. As an example, relay segment element 120*a* may be an explosion stunt element 350*a*. As such, the vehicle may actuate a trigger, such as an overhead vehicle trigger 352*a* while being retained on the track. The trigger may initiate a simulated explosion such as explosion of the top of the silo as shown in FIG. 12. Following actuation of the trigger 352*a*, the vehicle may continue along and exit relay segment 118*a*. Additional stunt elements may be added to the end of the track or the track may be terminated.

Figure 17:
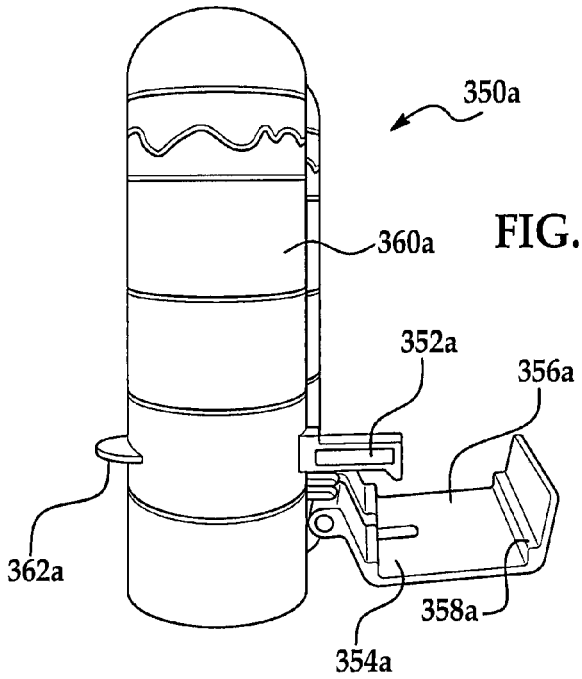

An example explosion stunt element 350*a* is shown in more detail in FIG. 17. It is noted that the explosion stunt element is an overlap element, in contrast to a linking element. Linking elements interconnect by linking one track segment into another track segment. The track segments removably lock together to form a continuous track. Typically, the linking elements including sliding male/female connectors. In contrast, as an overlap element, element 350*a* includes a track bed 354*a* which is configured to be positioned such that the track travels through the track bed. As an example and as shown in FIG. 17, the track bed may include a track receiver 356*a* such that a section of the track, such as a track connector section, may be slid into the receiver 356*a* and retained by retainer 358*a*.

A vehicle traveling along the track may actuate trigger or lever 352*a* to affect a stunt. Although shown as an overhead trigger, the trigger may be in any suitable position which does not substantially impede the travel of the vehicle. In other embodiments, the trigger, and/or additional structure following actuation of the trigger, may stop the travel of the vehicle. In the illustrated embodiment, activation of the lever (via contact with a traveling toy vehicle on the track) may cause the top of the silo 360*a* to launch upward to simulate an explosion. Although in the illustrated embodiment the silo explodes in a single piece, in alternative embodiments, multiple portions of the explosion element may separate. Stunt element further comprises a manual trigger element 362*a*, manual element 362*a* is coupled to 352*a* such that movement of manual element 362*a* causes a catch to release a spring to launch a top portion 361*a* away from the stunt element 350 to simulate an explosion.

While FIG. 12 shows various example relay segments with multiple stage stunts, as well as without stunts, numerous variations in relay elements are possible. Further, although shown in regards to a single track, it should be understood that virtually any number of different track designs may be used without departing from the scope of this disclosure. For example, parallel track configurations may be used, as well as combination sequential/parallel track configurations may be used. Further, various stunts may be performed, rather than the drops and/or loops shown, such as jumping over voids, traversing obstacles, etc.

Figure 18:
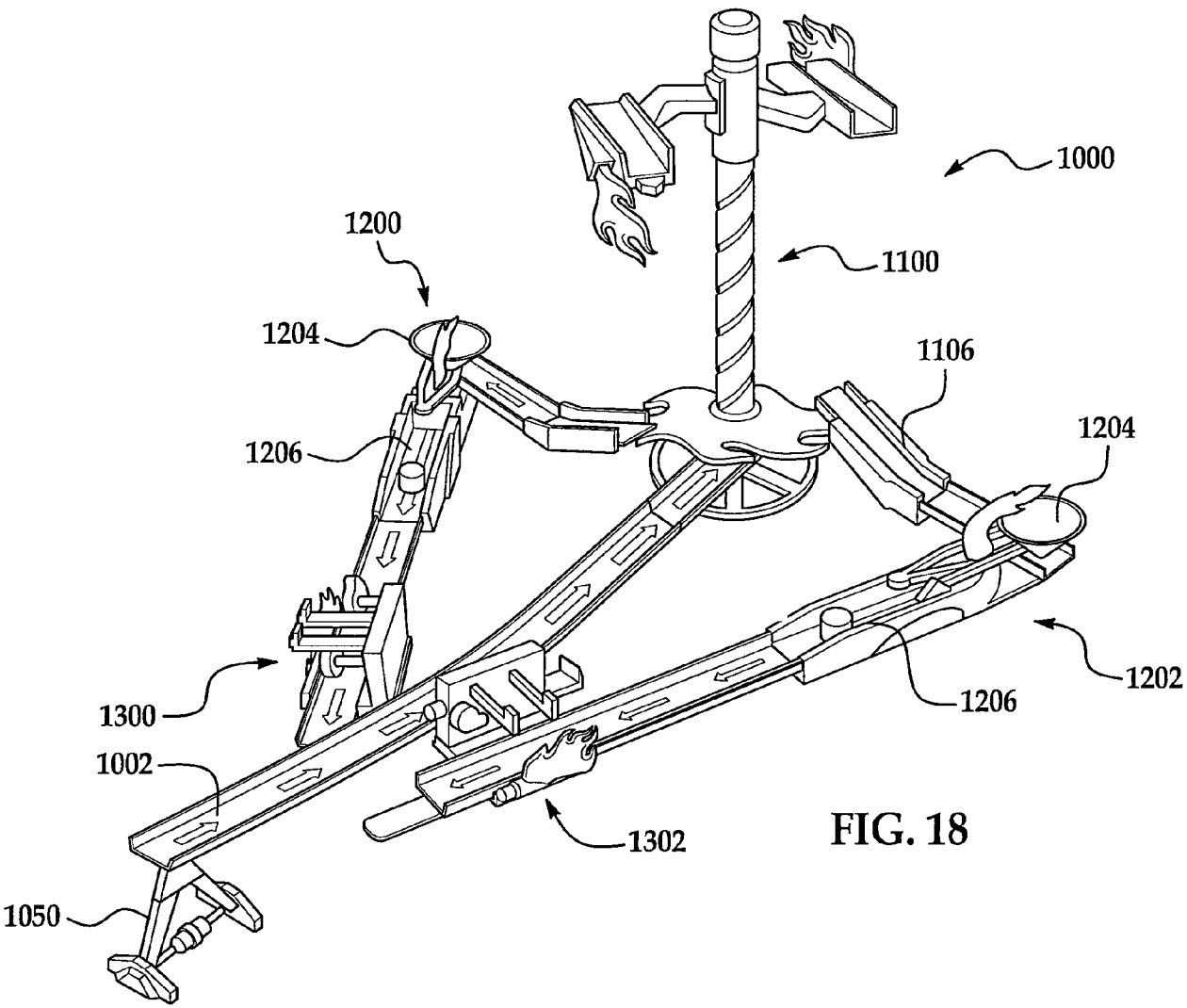
FIG. 18 shows still another example toy vehicle track set including a plurality of relay segments.

FIG. 18 provides another example track set 1000*a*. Track set 1000*a* includes a plurality of relay segments, 1100*a*, 1200*a* and 1300*a*. Further, example track set 1000*a* illustrates track accessory 1050*a*. As discussed regards to FIG. 12, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. Similarly, track accessories may be selectively positioned anywhere along the track.

As an example track accessory, flip accessory 1050*a* enables the user to selectively raise the track 1002*a* to improve vehicle travel along the track. Such an accessory enables adjustment of the track such that the speed of the vehicle may be increased. Other accessories may be used to increase or decrease speed, adjust the angle or the track, or otherwise alter the vehicle pathway. As such, the flip accessory may be coupled to one or more track segments that may be mounted to a higher altitude position, such that gravity may "launch" the incoming vehicle.

Track 1002 may be attached to a pivot plate 1064. In some embodiments, track 1002, such as a track connection section, may be snapped onto pivot plate 1064. In other embodiments, the track may be slid onto pivot plate 1064 or otherwise coupled to plate 1064. Further, although described as a pivot plate in this example, it should be appreciated that the pivot plate may be any suitable structure to enable support and coupling of the track. Use of the flip accessory may enable the track to be positioned such that a steep angle is created for vehicle travel. Vehicles released from the top of the track will increase speed such that the vehicles have sufficient speed to actuate the various triggers of the relay segments. Further, increased vehicle speed enhances play value of the track set.

A vehicle released on track 1002*a* may travel to relay segment 1100*a*. Relay segment 1100*a* may be a stunt element, such as a spiral crash stunt element. Incoming track 1102*a* may enable the incoming vehicle to actuate a trigger initiating a spiral crash stunt event. Completion of the stunt may result in two vehicles being released from two exit tracks 1104*a*, 1106*a*. Two vehicles are now traveling on the track set. Alternative pathways may be defined for such vehicles or parallel pathways. As described in more detail below, in the illustrated embodiment, the example track set has been configured such that a first vehicle travels to relay segment 1200*a* and 1300*a* and the second vehicle travels to relay segment 1202*a* and 1302*a*.

Figure 19:
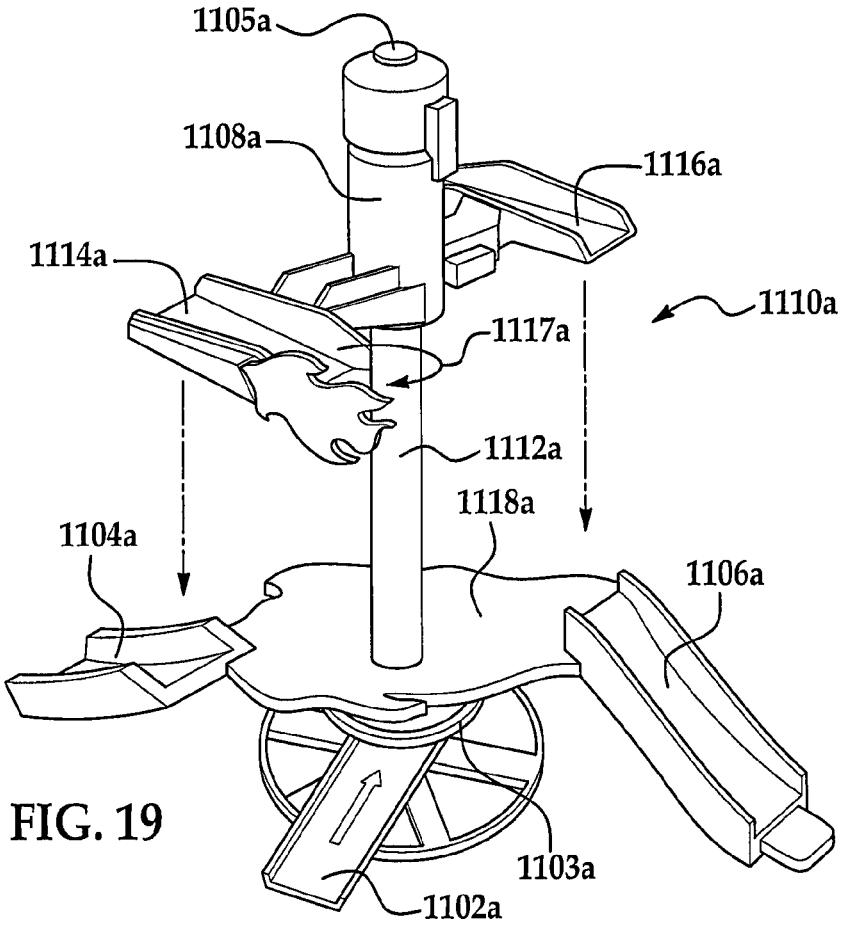
FIGS. 19 and 20 illustrate still other relay segments in accordance with exemplary embodiments of the present invention.

FIG. 19 illustrates an example spiral crash stunt element 1110*a*. As illustrated, spiral crash stunt element is configured to provide a spiral crash drop for two preloaded vehicles. As shown, incoming track 1102*a* is coupled to a vehicle trigger, such as a conical trigger 1103*a*. It should be appreciated that other trigger configurations are possible, including other vehicle trigger configurations, as well as manual trigger configurations, such as a manual trigger 1105*a*. In this example, the vehicle trigger 1103*a* may be spring loaded in a downward position, such that contact by an incoming vehicle on track 1102*a* causes the trigger to move vertically and through a rod linkage release traveler 1108*a* from a start position such that the traveler spirals down rod 1112*a* releasing preloaded vehicles onto exit tracks 1104*a* and 1106*a*.

Two preloaded vehicles may be positioned on carriers 1114*a* and 1116*a*. The carriers extend outward and are part of traveler 1108*a*. Upon actuation of trigger 1103*a*, traveler 1108*a* may be released from the start position such that the traveler rotates downwards as indicated by arrow 1117*a* about rod 1112*a*. Gravity pulls the traveler downwards with the rod including spiral coil structures which force the traveler to spin as it heads down the rod. A stop plate 1118*a* stops the traveler in a release position where both carrier 1114*a* and 1116*a* are aligned with exit tracks 1104*a* and 1106*a*, respectively. Preloaded vehicle may be released onto the exit tracks as outgoing vehicles from spiral crash stunt element 1110*a*.

It should be noted that each of the relay segments may be configured to fold to enable storage and/or reduce packing size. As such, many of the pieces of each relay segment are articulated to enable the pieces to fold and the structure to collapse inward. Further, in some embodiments, the relay segments are configured such that at least a top and bottom surface are substantially planar. The substantial planarity enables the relay segment to be more easily packaged or stacked for storage. The folding enables easy storage without the difficulties and frustrations that arise when such structures need to be disassembled for storage or packing.

As discussed above, spiral crash stunt element 1110*a* is configured as relay segment 1100*a* in FIG. 18. After actuation of relay segment 1100*a*, two preloaded vehicles are released on exit tracks 1104*a* and 1106*a* respectively. Additional relay segments may be interposed to improve game play. For example, in the illustrated embodiment, a direct acting relay segment, such as a launch stunt element as shown and discussed in regards to FIG. 3 is shown in the example track set. However, it should be appreciated that any other stunt element may be selectively connected to one or both of exit tracks 1104*a* and 1106*a*.

Referring back now to FIG. 18, outgoing vehicles from relay segments 1200*a*, 1202*a* may be incoming vehicles for relay segments 1300*a*, 1302*a* respectively. As an example, relay segments 1300*a*, 1302*a* may be any stunt element. As illustrated, both relay segment 1300*a*, 1302*a* are flip stunt elements.

Figure 20:
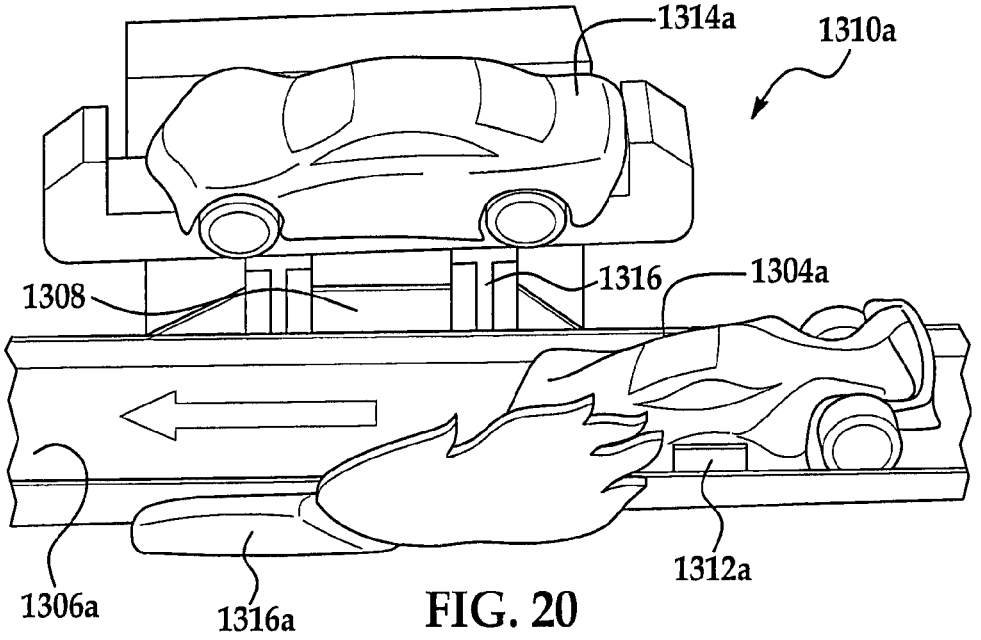

FIG. 20 illustrates an exemplary flip stunt element 1310*a*. As illustrated, flip stunt element 1310*a* is configured to flip a preloaded stunt vehicle. As shown, incoming track 1304*a* enables a vehicle 1312*a* to contact a trigger 1308*a* and then exit on exit track 1306*a*. Flip stunt element 1310*a* may be a stunt element where the incoming vehicle is the outgoing vehicle. As such, the vehicle may actuate a trigger, such as an overhead vehicle trigger 1308*a*, while being retained on the track. The trigger may actuate the flipping of a preloaded vehicle 1314*a* from a carriage 1316*a*. Following actuation of the trigger 1308*a*, the vehicle may continue along and exit relay segment 1310*a* along exit track 1306*a*.

Similar to the explosion stunt element described above, flip stunt element is an overlap element. As such, flip stunt element 1310*a* includes a track bed 1316*a* which is configured to receive a section of the track, such as a track connector section. The track may be slid into the track bed.

Carriage 1316*a* is configured to hold the preloaded vehicle prior to actuation of the flip stunt element. The vehicle may be supported by extensions and is configured to rotatively connected to the carriage such that activation of trigger 1308*a* causes rotation of the carriage such that the toy vehicle held therein is flipped or thrown from the track area.

Figure 21:
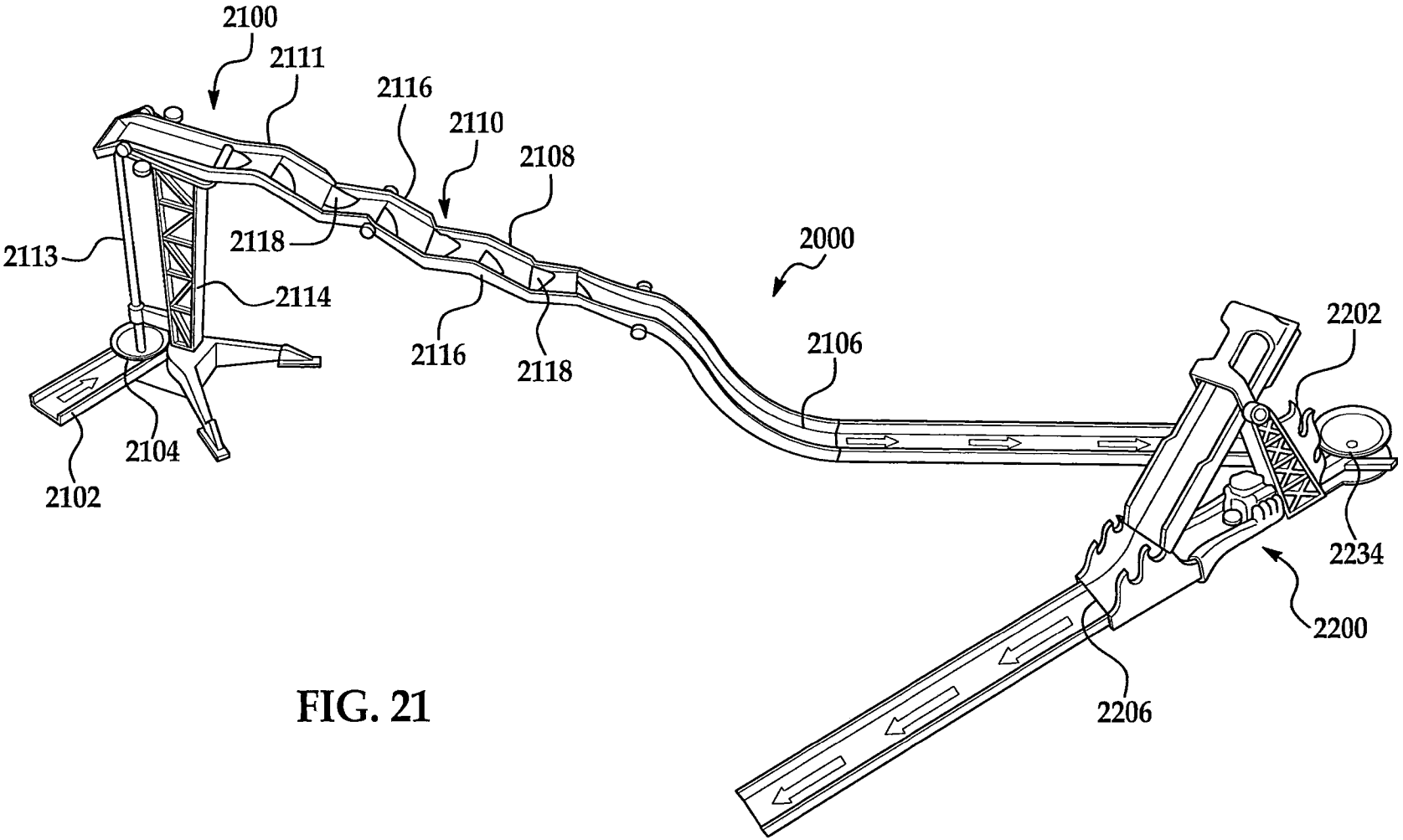
FIG. 21 illustrated still another toy vehicle track set in accordance with another exemplary embodiment of the present invention.

Referring now to FIG. 21 another exemplary track set 2000 is illustrated. Track set 2000 includes relay segments 2100 and 2200. As discussed with regard to FIGS. 12 and 18, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns.

In the illustrated track set 2000 an incoming vehicle travels along incoming track 2102 to actuate trigger 2104 of relay segment 2100. Relay segment 2100 may be a stunt element, such as a gravity-actuated zig-zag ramp stunt element. Thus, the incoming vehicle initiates the stunt, following which the pre-loaded stunt vehicle exits stunt 2100 at 2106 toward the subsequent stunt 2200.

Specifically, FIG. 21 illustrates an example gravity-actuated zig-zag ramp stunt element 2110. As illustrated, zig-zag ramp stunt element 2110 is configured to provide a zig-zag track path 2108 for a preloaded stunt vehicle. As shown, incoming track 2102 is coupled to a conical trigger 2104. It should be appreciated that other trigger configurations are possible, including other vehicle trigger configurations, as well as manual trigger configurations. In this example, the trigger may be spring loaded in a downward position, such that contact by an incoming vehicle on track 2102 causes the trigger to move vertically and release a vehicle stop 2111 (such as through rod linkage 2113) such that a preloaded stunt vehicle stored at 2112 is released down zig-zag track path 2108.

The zig-zag ramp stunt element 2110 includes a support brace 2114 which maintains the start of the zig-zag track path in a relatively high vertical position. Gravity enables the car to move down the path. Although not required, in some embodiments, a spring-loaded launcher may be provided to further accelerate the vehicle along the zig-zag track path.

In some embodiments, various structures or designs may be used to indicate to a user the position for placing a preloaded vehicle. For example, different textures, paint or designs may be used to indicate that a vehicle should be loaded for activation in the stunt element.

In some embodiments, the zig-zag track may include angled sections which slow a vehicle down as it travels down the path. Rails 2116 may prevent the vehicle from careening off of the track. Further, cut-outs 2118 may be provided in the track to further disrupt the vehicles motion adding excitement to the stunt element. In some embodiments, the cut-outs and track shaped may provide enhanced excited my slowing the vehicle down such that additional anticipation is created.

It should be appreciated that other stunt elements may include speed control elements. These speed control elements include speed retarders and speed accelerators. Speed retarders, such as built-in delayed releases, controlled drops, speed, etc., may enhance play value by increasing the anticipation of an event. Further, speed accelerators, including ramp inclines, may, for example, increase play value by keeping vehicles moving through the track set.

In accordance with an exemplary embodiment of the present invention and referring to FIG. 21, the outgoing vehicle from relay segment 2100 travels to relay segment 2200. The outgoing vehicle is now the incoming vehicle for relay segment 2200 and travels along incoming track 2202 to actuate trigger 2204 of relay segment 2200. Relay segment 2200 may be a stunt element, such as a shock drop stunt element. Thus, the incoming vehicle initiates the stunt, such that pre-loaded stunt vehicle exits stunt 2200 at 2206 toward a subsequent relay element (not shown) or end.

Figure 22:
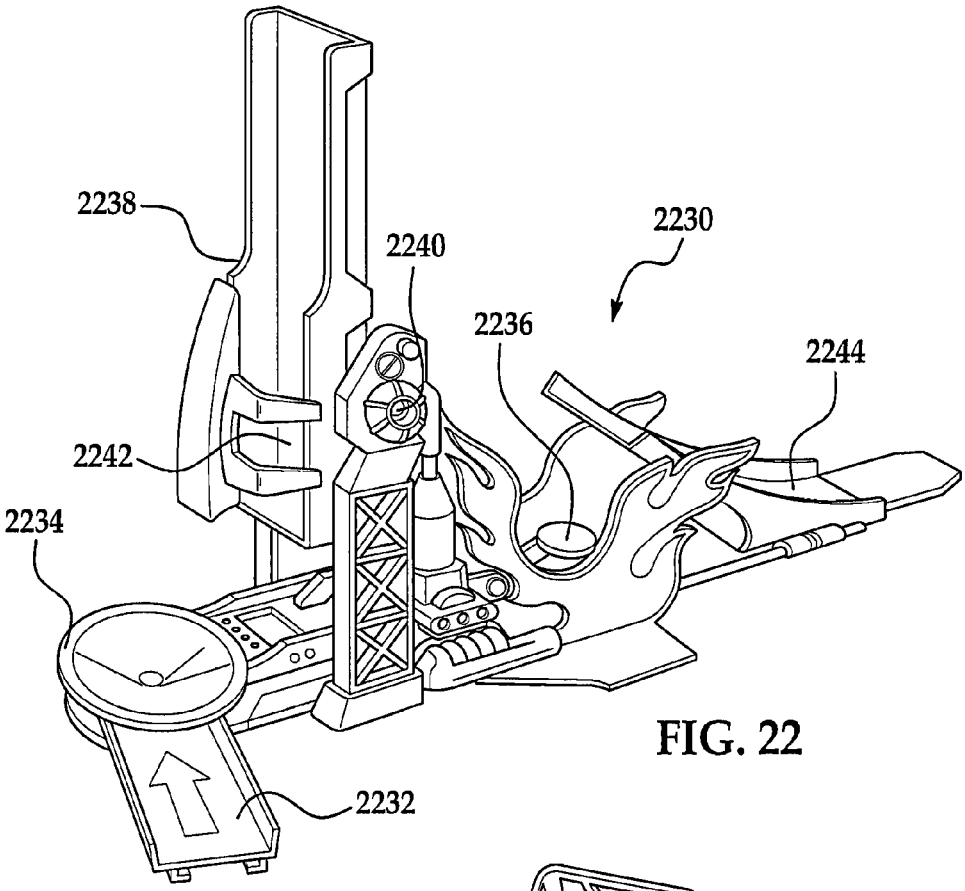
FIGS. 22-23 illustrate yet another exemplary relay segment.

FIG. 22 illustrates rotating ramp launch stunt 2230 as an example of an indirect acting relay segment having a gravity actuated rotating ramp launch stunt. Specifically, an incoming track 2232 is moveable mounted to the relay segment proximate to a conical trigger 2234, which can also be actuated via the manual button 2236. In this example, the trigger when in the downward position locks an actuatable spring loaded member in an unreleased or loaded position, such that contact by an incoming vehicle on track 2232 causes the trigger to move vertically, and initiate rotation of rotating ramp 2238 about axis 2240. A vehicle may be pre-loaded and positioned within rotating ramp 2238 at end 2242 such that upon swinging downward and stopping in the downward position, a vehicle is launched down exiting track section 2244.

Figure 23:
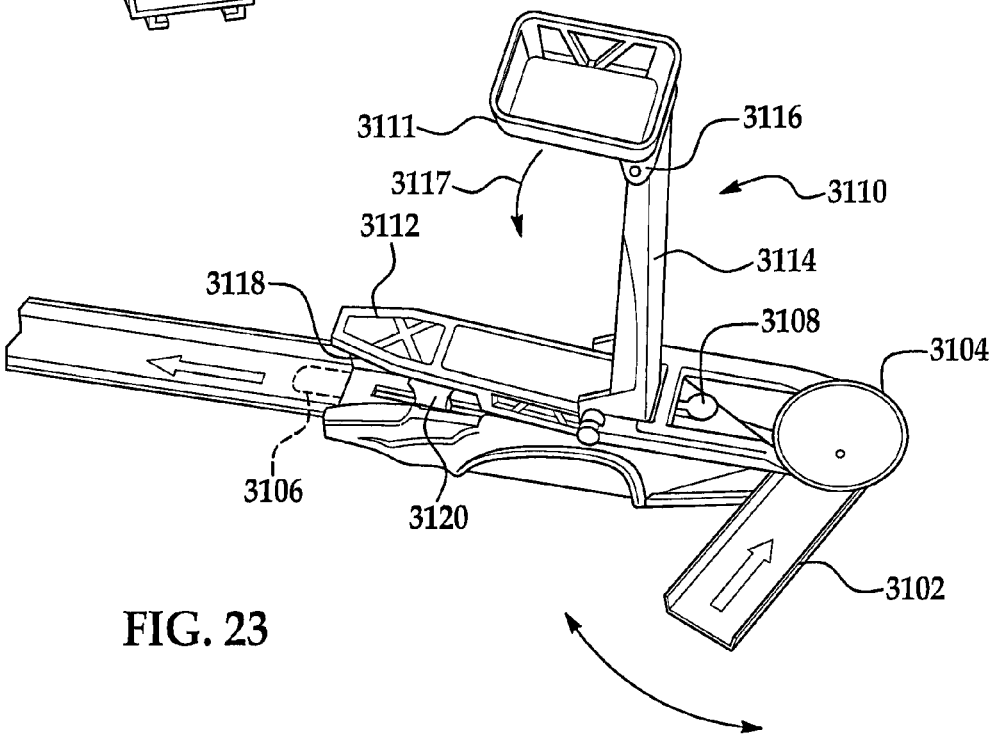

Referring now to FIG. 23 still another relay segment is illustrated. Here the relay segment is a free-fall stunt element 3110. As illustrated, free-fall stunt element 3110 is configured to provide a free fall stunt for a preloaded vehicle. As shown, incoming track 3102 is coupled to a conical trigger 3104, which can also be actuated via the manual button 3108. In this example, the trigger may configured to release a spring loaded stunt element such that contact by an incoming vehicle on track 3102 causes the trigger to move vertically and release a catch that then releases a vehicle basket 3111 such that a preloaded stunt vehicle free falls to target 3112.

The vehicle basket 3111 may be hingedly connected to an arm 3114 as indicated at pivot point 3116. A vehicle may be preloaded in the basket. Activation of trigger 3104 results in the basket swinging downwards, as indicated by arrow 3117, such that the vehicle drops out of the basket and falls toward the ground. FIG. 23 illustrates the basket 3111 in a pre-trigger configuration, where the basket is substantially perpendicular to the arm.

In some embodiments, the preloaded stunt vehicle is configured to fall onto a target 3112. The target may be part of a platform or other structure. Upon impact with the target, a third vehicle may be released. As an example, a second preloaded vehicle may be positioned in cavity 3118. Cavity 3118 may include launching structure such as a spring loaded launch slider 3120 which upon activation slides forward, causing the second preloaded stunt vehicle to be accelerated toward exit 3106. This second preloaded vehicle becomes the outgoing vehicle of relay element 3100.

Referring now to FIGS. 24-33D an alternative exemplary embodiment of the present invention is illustrated. Here a track set 4100 having three relay segments 4110, 4112, and 4114 is shown at least in FIG. 24. In this embodiment, a user may customize the track set by positioning the relay sections in any desired portions of a track set including other relay segments disclosed herein.

As illustrated, each relay segment 4110, 4112, and 4114 includes an incoming vehicle trigger, movable member or release mechanism which may directly or indirectly causes the launching of another outgoing vehicle or object, wherein the outgoing vehicle or object from one segment may become the incoming vehicle or object of a next segment that strikes the trigger, movable member or release mechanism of the next segment.

Although any suitable launcher may be used, in the illustrated embodiments, various automatically and manually-triggered release launcher elements are illustrated. In one implementation, a vehicle may be positioned in a launch position such that a launch element may slidingly engage the vehicle to propel the vehicle along the track. The launch element may be biased to a launch position, such as by springs, elastic bands or any other suitable biasing mechanism such that release of an activator releases its stored potential energy.

In one embodiment, the relay segments may include a trigger, such as a conically shaped trigger, angled trigger shapes that are not necessarily conical or a movable member. In some relay segments, actuation of a trigger by a first vehicle or object initiates a stunt and release of a second vehicle on the track set.

Figure 24:
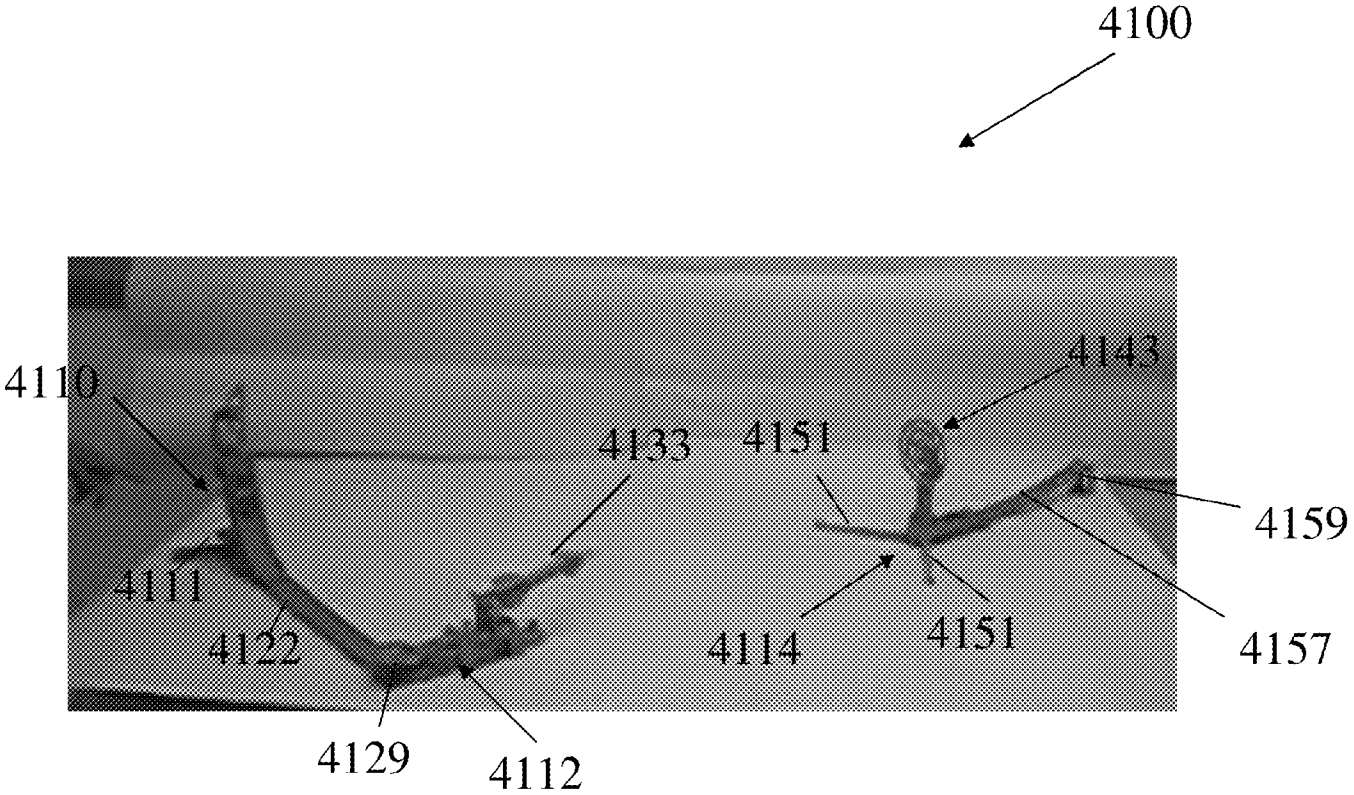
FIGS. 24-33D illustrate still other alternative exemplary embodiments of the present invention.
Figure 25B:
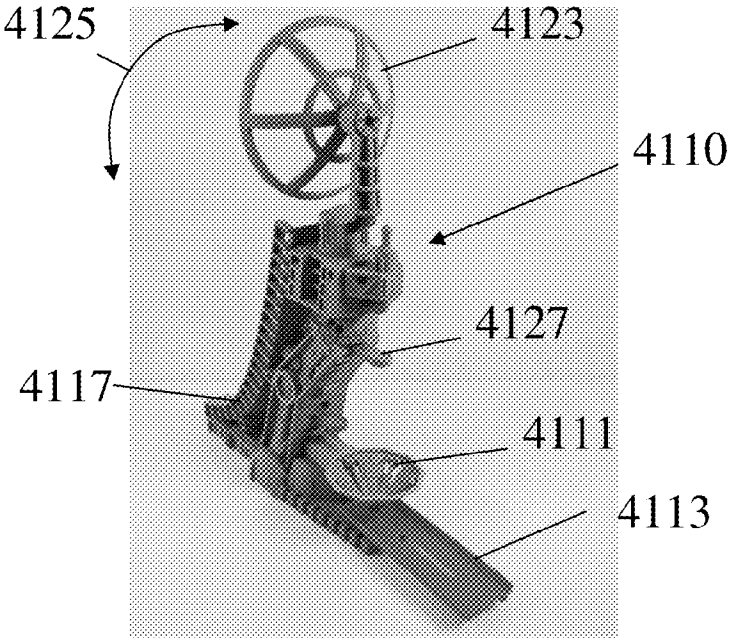
Figure 25A:
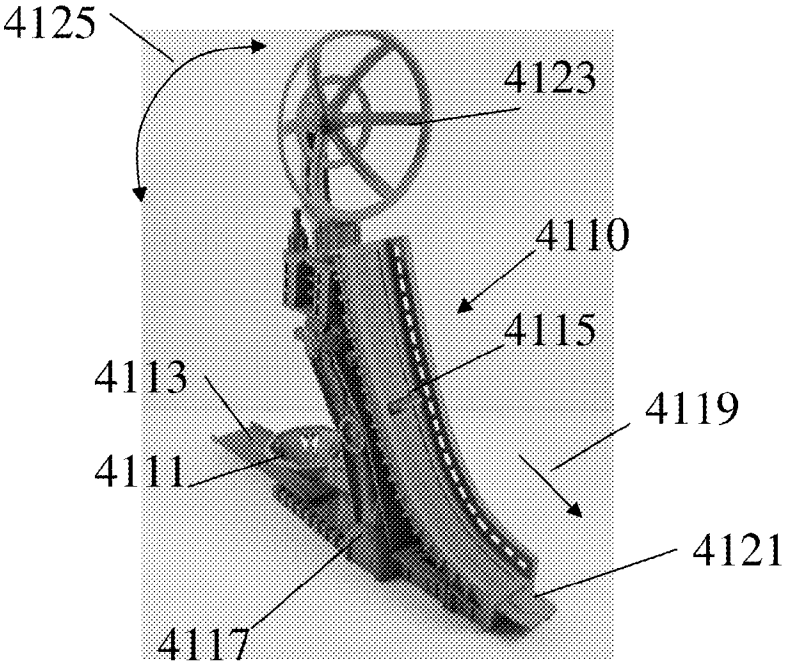

Referring now to at least FIGS. 24-25B, relay 4110 is illustrated here relay 4110 has a trigger mechanism 4111 similar to the previous embodiments wherein movement of the trigger mechanism from a first position to a second position will cause the relay 4110 to perform a function and release an object or car towards another relay of the track set. As illustrated, relay 4110 has a track segment 4113 pivotally secured to the relay proximate to the trigger such that an incoming vehicle may move trigger 4111. Once trigger 4111 is moved to the second position a tab 4115 is retracted into a track 4117 of the relay and an object or car being held behind tab 4115 is free to traverse down track 4117 in the direction of arrow 4119 towards another relay. Relay 4110 also has a tongue member 4121 for securement to another track segment 4122.

In addition and in one embodiment, relay 4110 also has a member 4123 rotatably mounted to the relay such that once trigger 4111 is manipulated member 4123 is rotated by a mechanism located within the relay such that the member 4123 rotates in the directions of arrows 4125. In one embodiment, member 4123 is configured to resemble a radar dish and movement thereof simulates scanning of an area to provide a general theme to the track set. Accordingly and in one non-limiting implementation of this embodiment, movement of trigger 4111 from the first position to the second position will ultimately cause tab 4115 to be retracted such that an object may travel down track 4117 however rotation of member 4123 may occur before, during or after retraction of tab 4115. If movement of member 4123 occurs before retraction of tab 4115 there will be a time delay from movement of the trigger to the second position and retraction of tab 4115.

Additionally, relay 4110 can also have a manual trigger mechanism 4127 that will retract tab 4115 and cause rotation of member 4123 without requiring movement of trigger 4111.

Referring now to at least FIGS. 24-26D, relay 4112 is illustrated. Here relay 4112 has a trigger mechanism 4129 similar to the previous embodiments wherein movement of the trigger mechanism from a first position to a second position will cause the relay 4112 to perform a function and release an object towards another relay of the track set. As illustrated, relay 4112 has a track segment 4131 pivotally secured to the relay proximate to the trigger such that an incoming vehicle may move trigger 4129. Once trigger 4129 is moved to the second position an object 4133 is launched towards another relay segment, which as illustrated in FIG. 24 is relay 4114.

In one embodiment, object 4133 is configured to resemble a missile that is configured to be received on a launching member or rod 4135 wherein a spring located either within missile 4133 or on rod 4135 is compressed when the missile is received on rod 4135 and a latch 4137 releasably secures the missile to the rod by having a feature 4139 that engages a portion of the missile. In this embodiment, movement of the trigger 4129 will release the missile and a compressed spring will launch the missile into the air. As illustrated, in FIGS. 26B and 26C the rod or launching member is capable of being located in a variety of positions from a vertical position illustrated in FIG. 26B towards a substantially horizontal position illustrated in FIG. 26C by pivotally securing rod 4135 to relay 4112. It is, of course, understood that any angular configuration of rod 4135 is contemplated to allow for the aiming of the missile towards other relays or just the launching of the missile. In addition, any suitable launching mechanism capable of being activated by the movement of trigger 4129 is also considered to be with the scope of exemplary embodiments of the present invention.

Accordingly and in one non-limiting implementation of this embodiment, movement of trigger 4129 from the first position to the second position will ultimately cause missile 4133 to be launched from the relay. In addition and similar to the other embodiments, relay 4112 can also have a manual trigger mechanism 4141 that will cause the missile to be launched from the relay.

Referring now to at least FIGS. 24-28, relay 4114 is also illustrated here relay 4114 has a release mechanism or trigger mechanism 4143 wherein movement of the trigger mechanism from a first position to a second position will cause the relay 4114 to perform a function and release an object or car towards another relay of the track set. As illustrated, release mechanism 4143 comprises a target surface 4145 secured to an arm member 4147, wherein the arm member is moveably mounted to the relay for movement between the first position and the second position. In this embodiment, the target surface and the relay are configured such that the release surface can be positioned in either the first or second position and movement therefrom towards either the first or second position will cause the relay to perform the function and release the object. In other words, movement of the arm member from one position to another will activate a launcher of the relay. For example, in FIG. 27 the target surface is in the first position vertically orientated with respect to relay 4114 such that movement towards the second position in the direction of arrow 4148 will activate a launcher 4149. In addition and in an alternative embodiment, the release mechanism and the target surface are rotatably secured to the relay for full 360 degrees rotation in the direction of arrows 4150 allowing for adjusting of the target surface in a variety of different positions. In this embodiment, arm member 4147 is pivotally secured to a base portion 4146 that is rotatably secured to relay 4114.

As illustrated, the relay will have a launcher 4149 that is activated by release mechanism 4143 as it moves from either the first position to the second position from the second position towards the first position or another position. Launcher 4149 is similar to the launcher described above and in particular FIGS. 3-3B and equivalents thereof.

Figure 29:
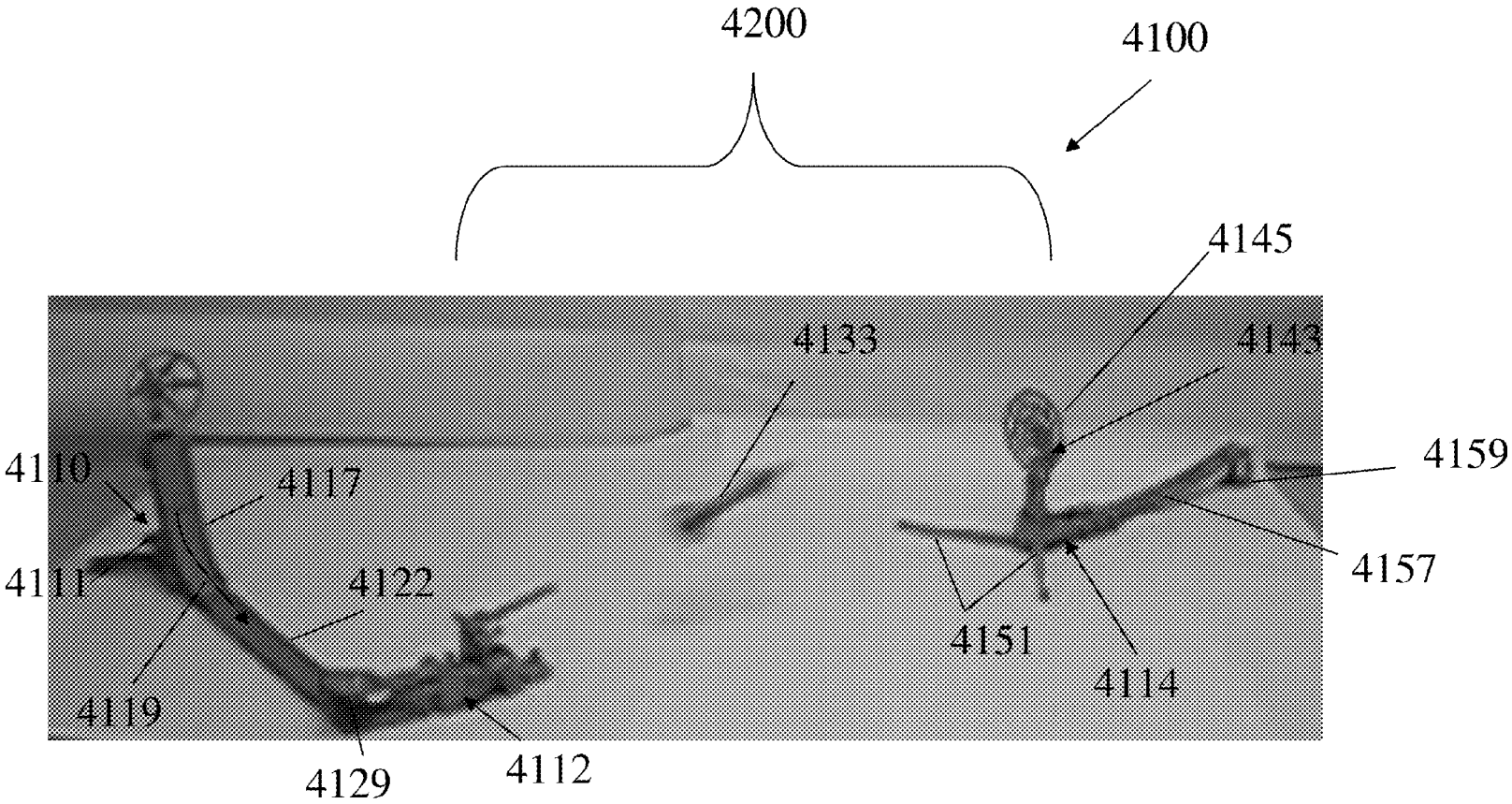
Figure 30:
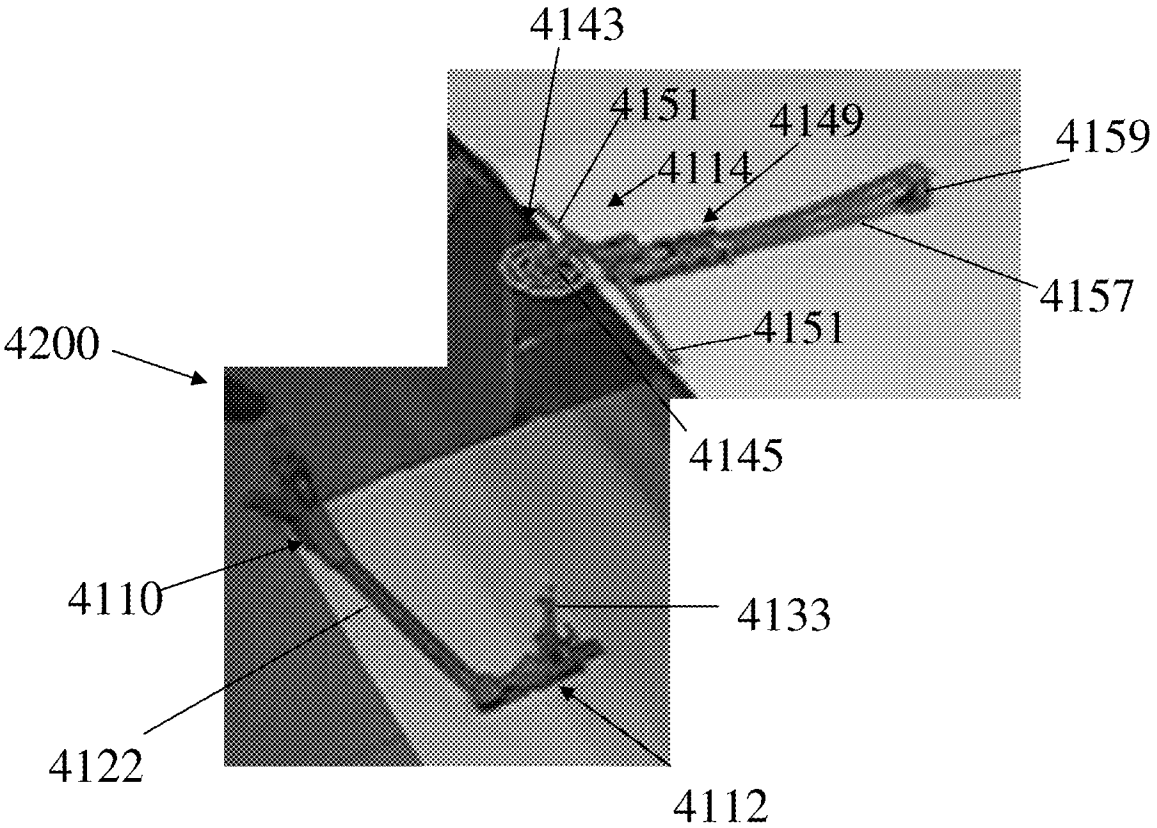
Figure 31:
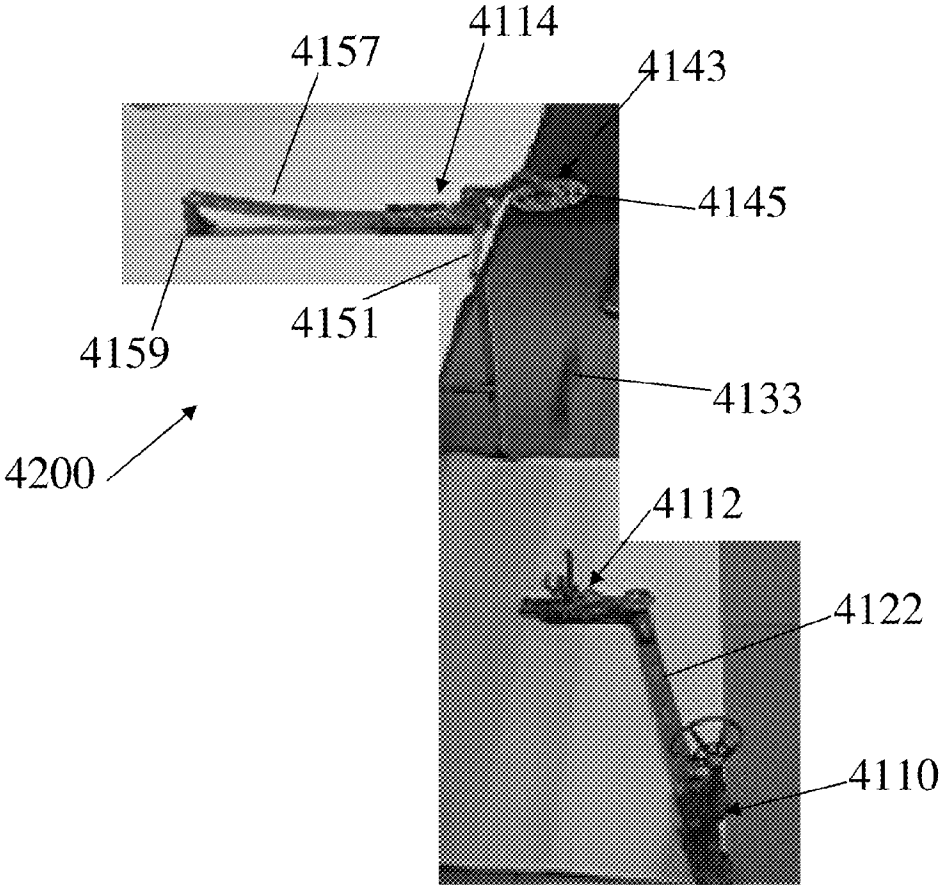
Figure 32:
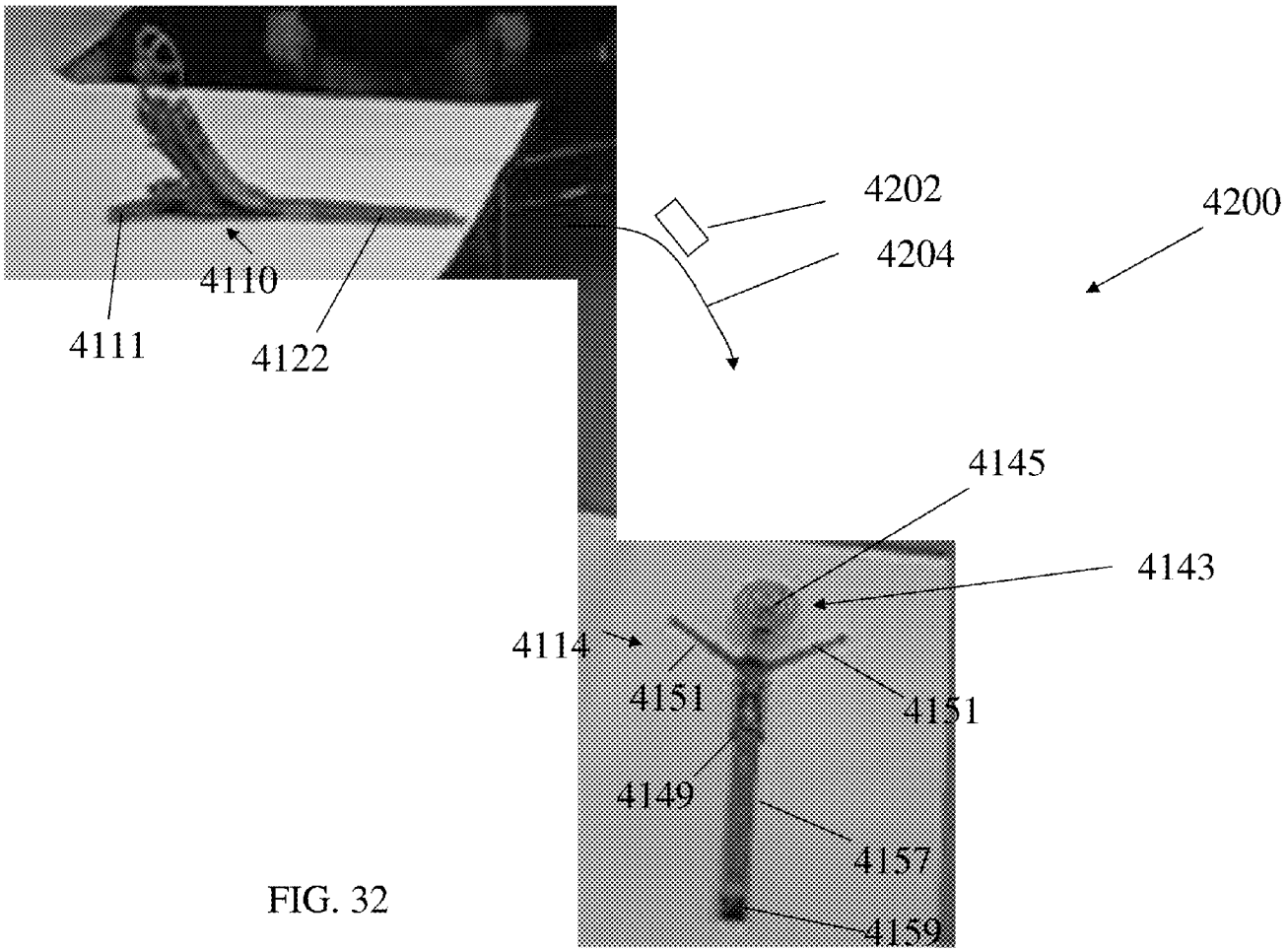

Since release mechanism 4143 is capable of activating launcher from either the first position or the second position, various configurations are capable of being provided for example, with the release mechanism and the target in a somewhat vertical configuration with respect to the relay an object striking the surface of the release mechanism and moving it towards a second position or a somewhat horizontal configuration with respect to the relay the launcher will be released and vice versa. FIGS. 24 and 29 show the release mechanism of relay 4114 in a vertical position while FIGS. 30-32 show the release mechanism in the second or horizontal position. In essence, relay 4114 provides a variably positionable target that when struck and actuated causes a toy vehicle or object to be released from relay 4114.

As illustrated, relay 4114 further comprises a pair of support legs 4151 each being pivotally mounted to relay to provide stability to the relay as the release mechanism is located in a variety of positions as well as provide a stable base such that objects striking the release member will move the same with respect to the relay without knocking it over.

Figure 26A:
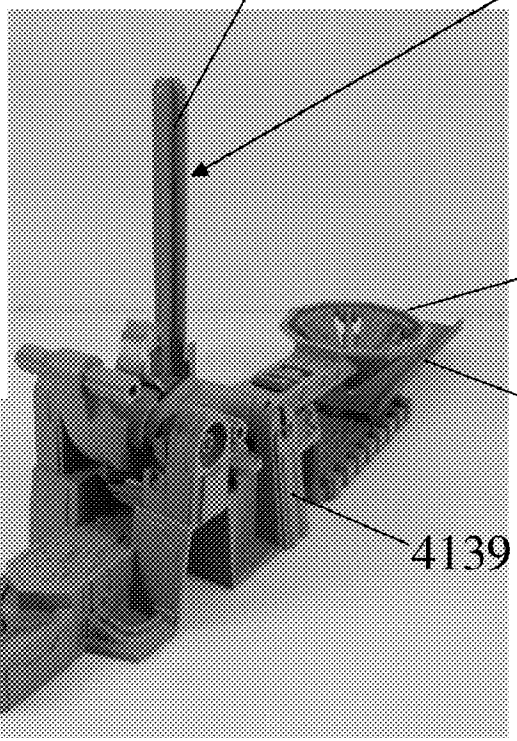
Figure 26C:
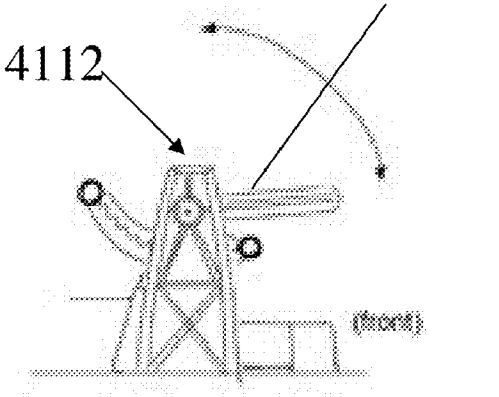
Figure 26B:
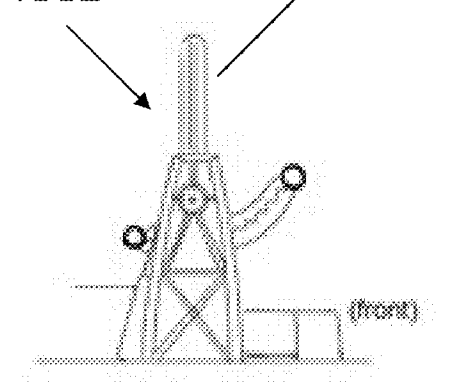
Figure 26D:
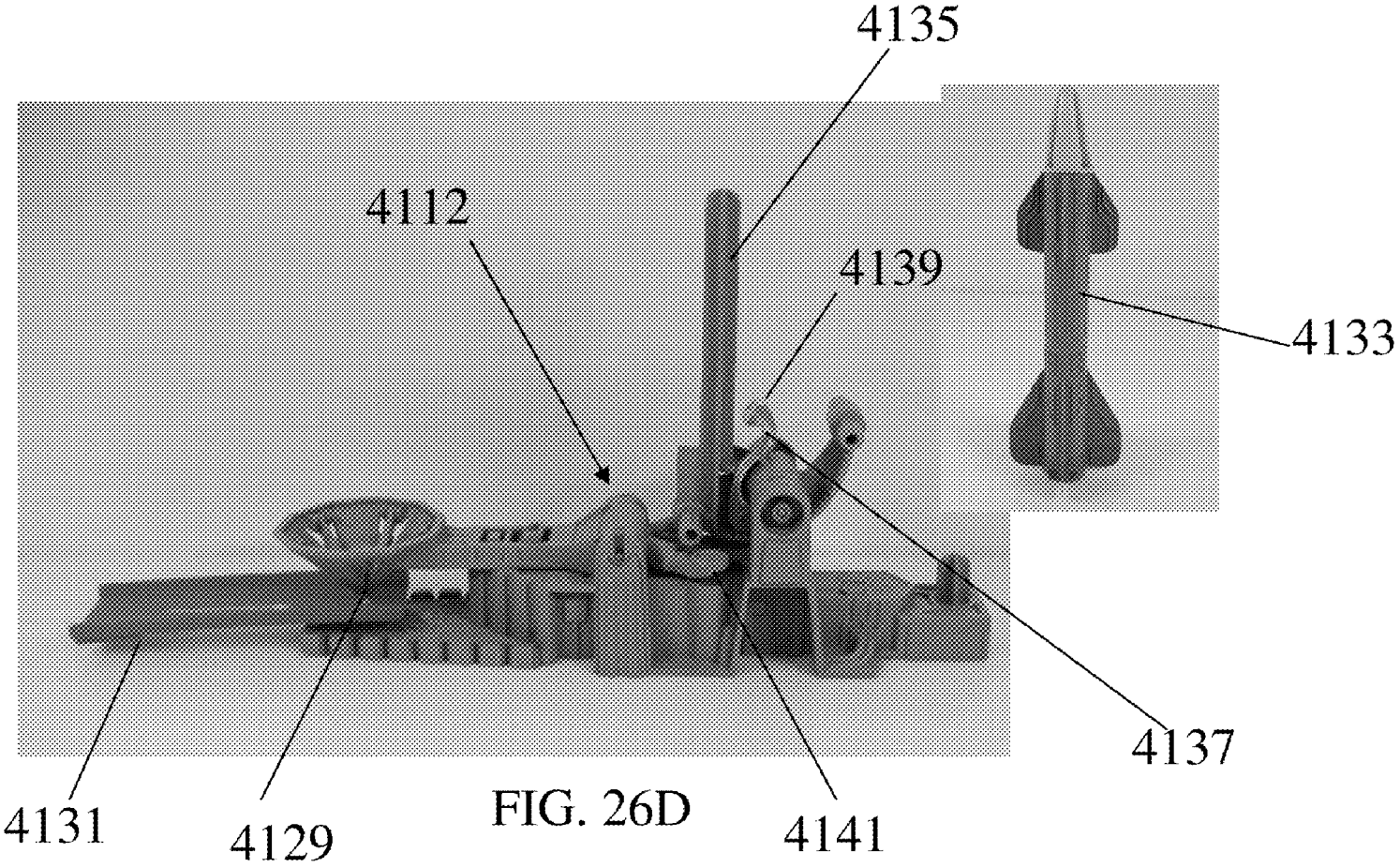
Figure 27:
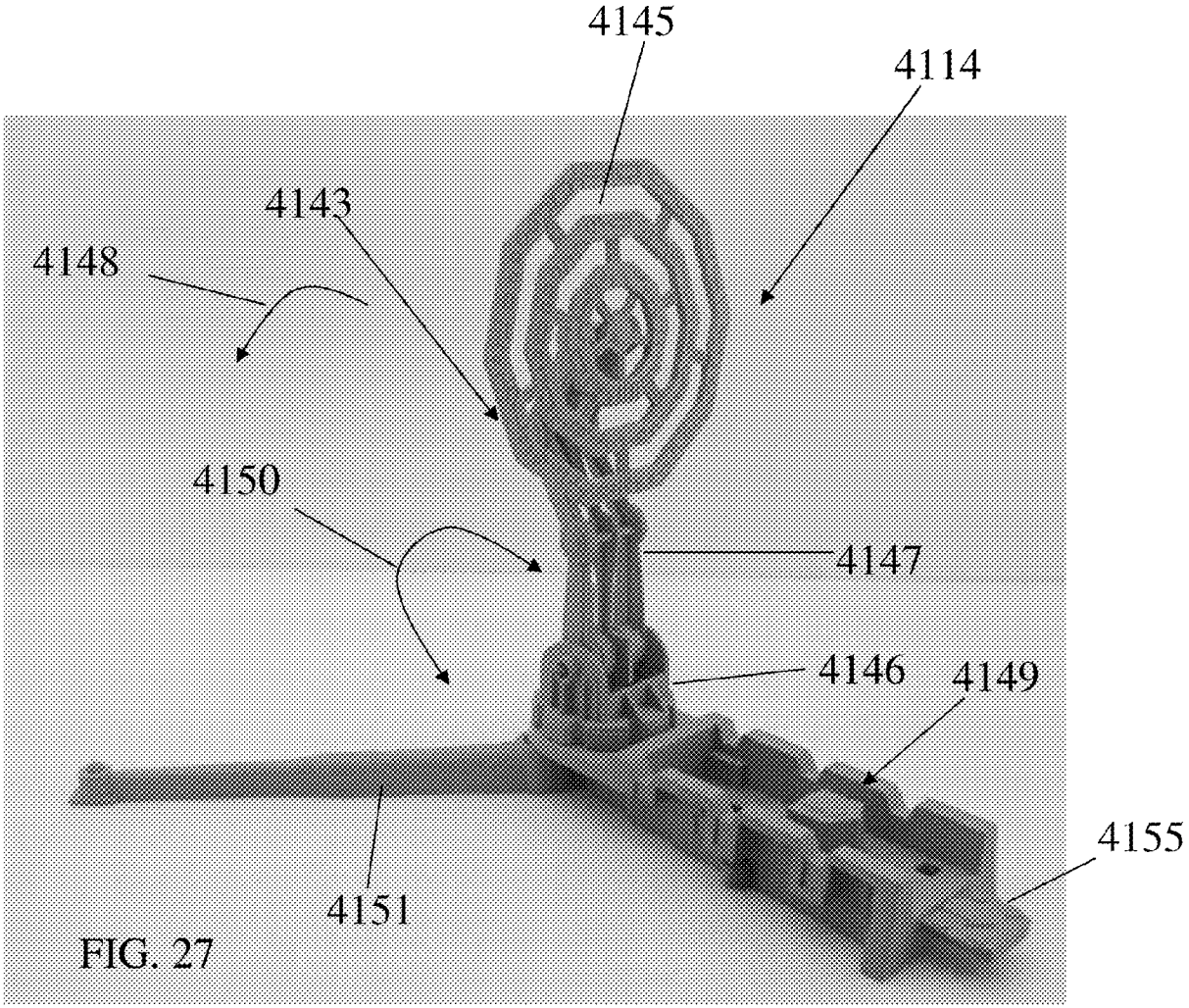
Figure 28:
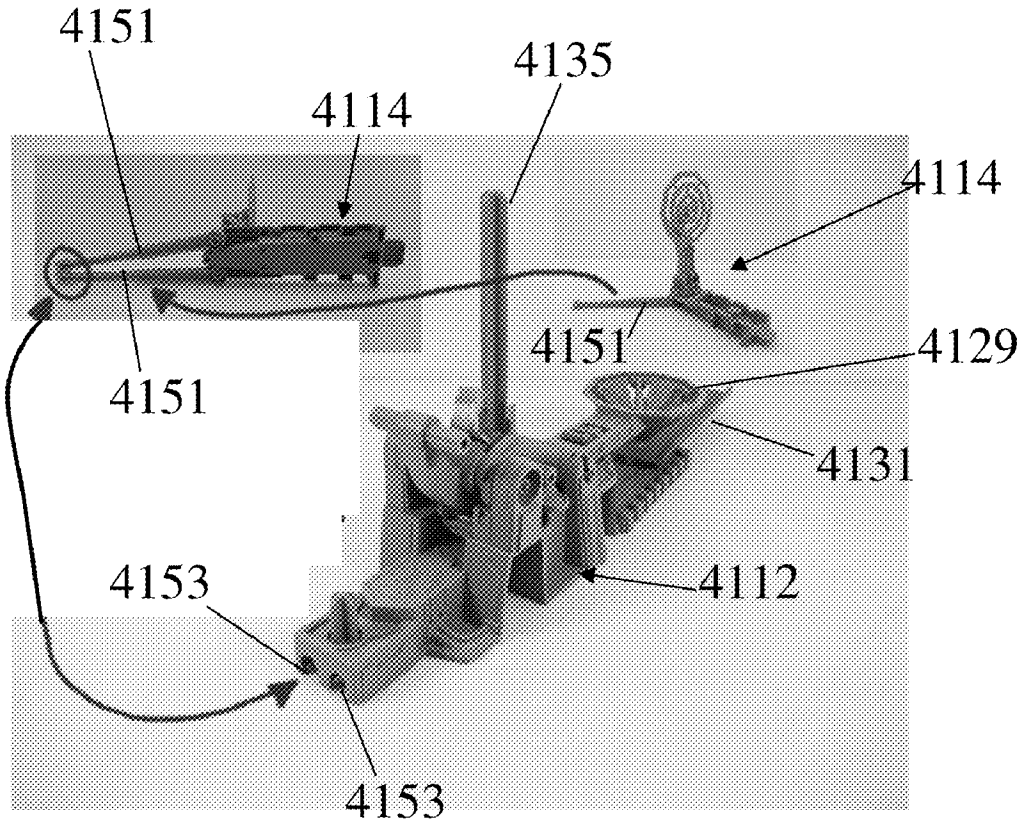
Figure 28A:
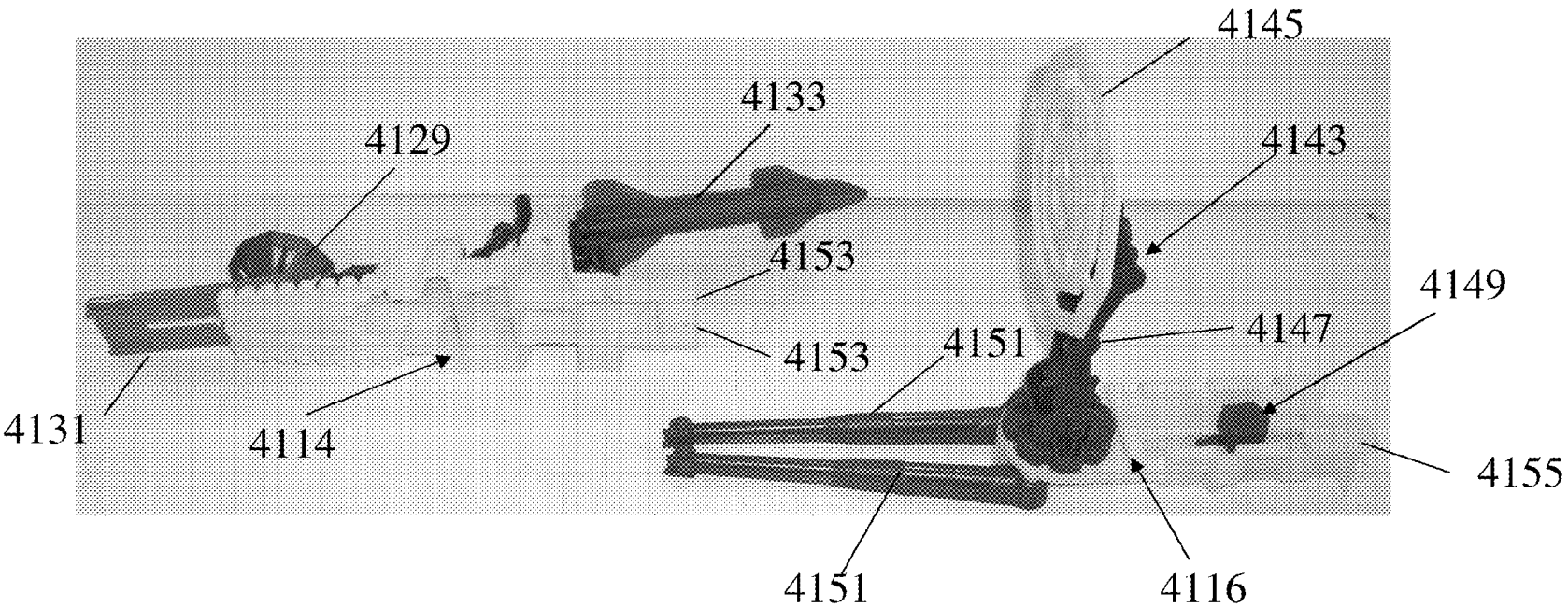
Figure 28B:
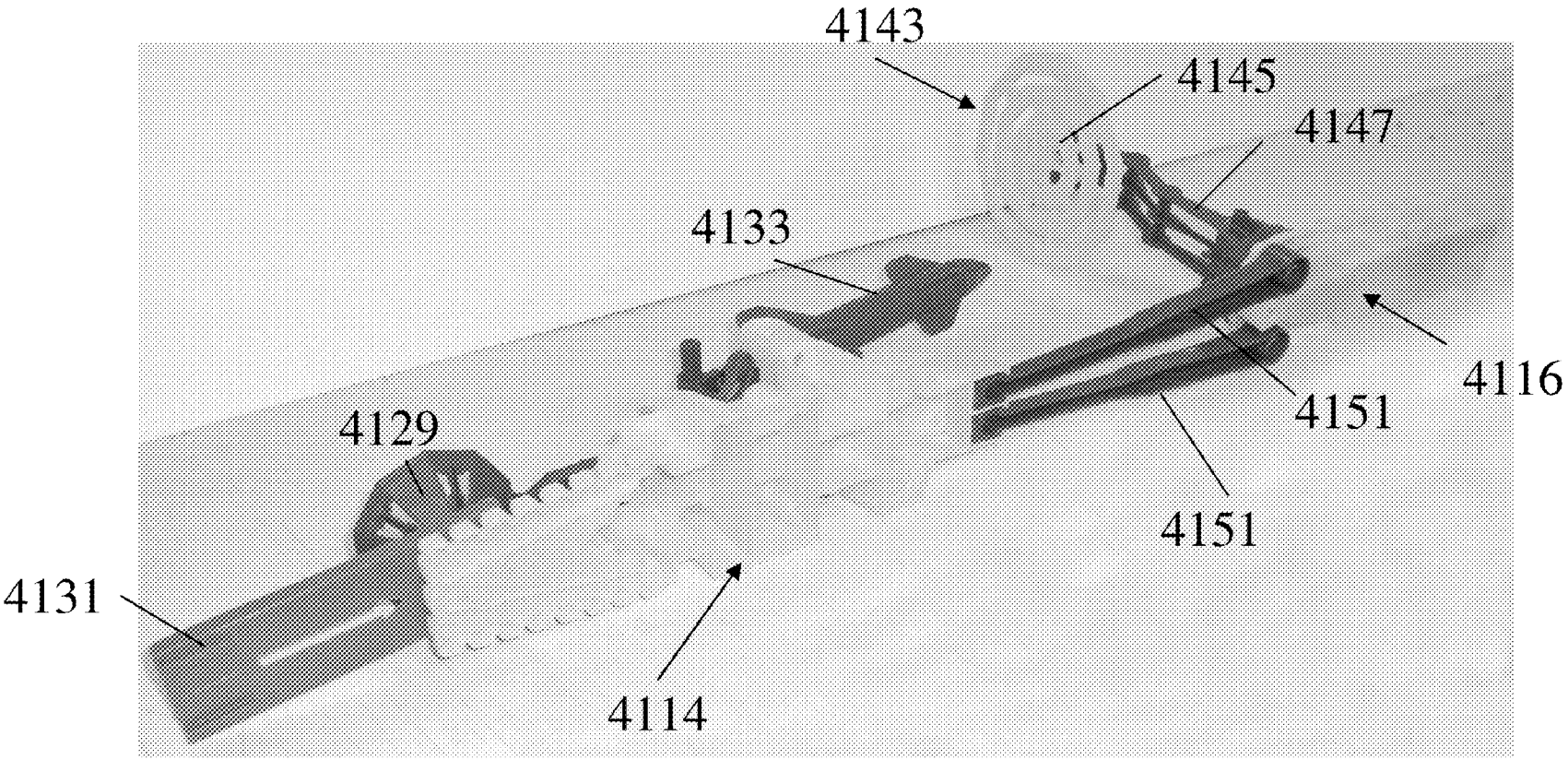
Figure 28C:
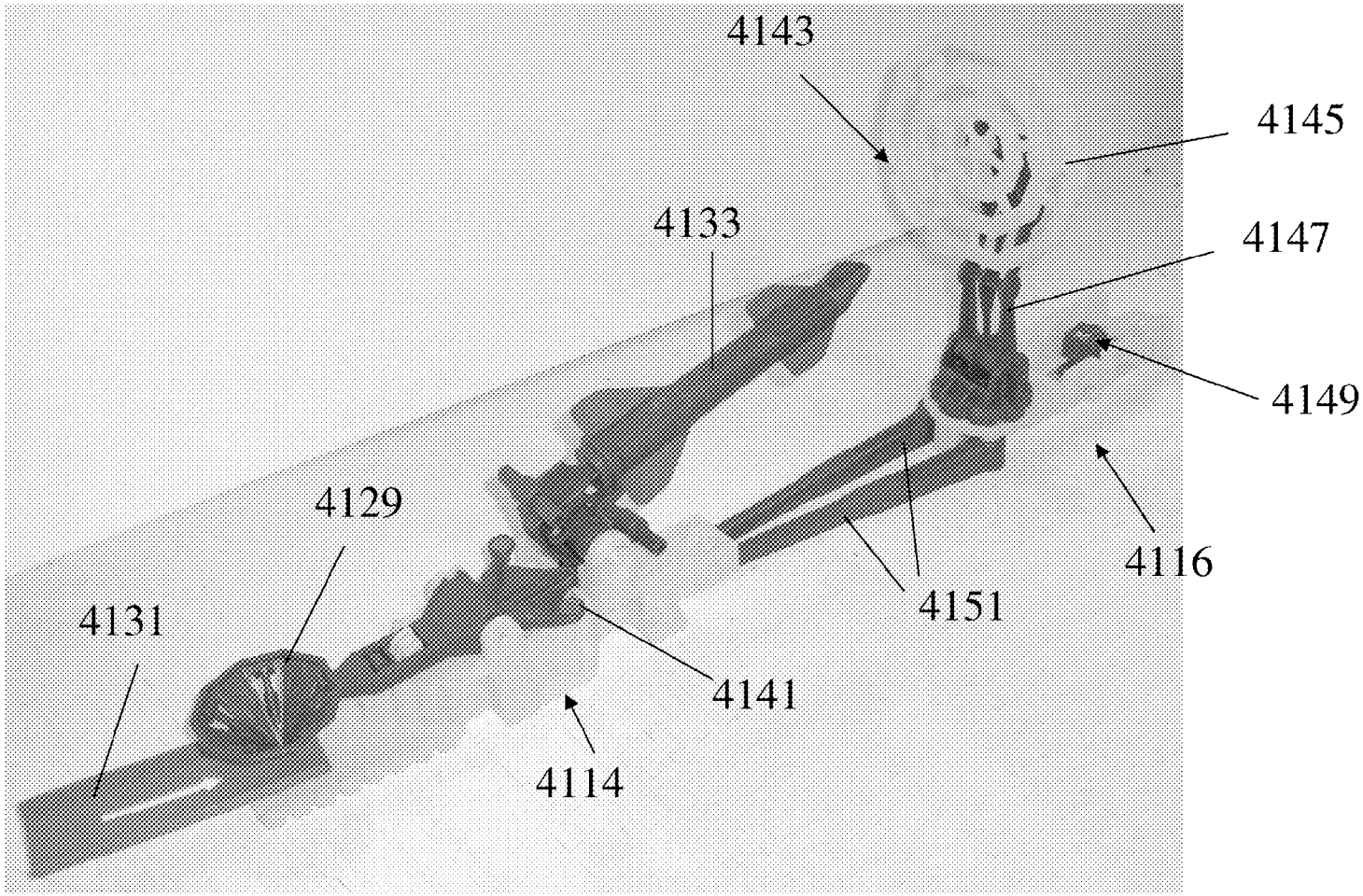

In another configuration and as illustrated in at least FIGS. 28-28C relay 4112 will a have an opening or pair of openings 4153 that are configured to receive support legs 4151 therein such that relay 4114 can be secured to relay 4112 and release mechanism or target 4145 can be located directly in front of missile 4133 when rod 4135 of relay 4112 is in the position of FIG. 26C or FIGS. 28B and 28C such that missile 4133 will most certainly hit target 4145 when it is released from relay 4114. This feature is useful for younger children who may not be skilled enough to align the target with the missile when there is a substantial distance therebetween such as the distance illustrated in FIG. 24.

Relay 4114 also has a tongue member 4155 for securement to another track segment 4157, which in one embodiment terminates with a jump via a platform 4159.

Referring now to FIGS. 24-29, track set 4100 is shown where relay 4110 has been activated via movement of trigger 4111 and a vehicle will travel down tracks 4117 and 4122 until it moves trigger 4129 of relay 4112. The movement of trigger 4129 will cause missile 4133 to be launched towards target 4145 of release mechanism 4143 wherein movement of the release mechanism causes the launcher 4149 to launch a vehicle or object along track 4157.

In addition and since relay 4112 and 4114 are spaced from each other, the combination of relays 4112 and 4114 may also be referred to a relay 4200 having a first actuator or relay 4112 configured to launch the object or missile 4133 into air and a second actuator or relay 4114 having the release mechanism 4143 (see at least FIG. 29). Since the release mechanism 4143 of relay 4114 and the rod or the launcher 4135 of relay 4112 are repositionable, the interconnection of actuators or relays 4112 and 4114 can be vertical or horizontal of any other configuration. For example and as illustrated in at least FIGS. 30 and 31, relay 4200 is shown with actuator or relay 4114 elevated from actuator or relay 4112. In this configuration, the launcher or rod 4135 of actuator 4112 is in a vertical position and the target 4151 of release mechanism 4143 is in a horizontal position such that it extends away from an edge of a surface upon which it is supported. Accordingly, missile or object 4133 is launched vertically to make contact with release mechanism 4143 and thus moves the same from a horizontal position toward a vertical position thereby activating launcher 4149. FIG. 30 shows the missile prior to launch and FIG. 31 shows the missile being propelled upwardly towards release mechanism 4143.

Referring now to FIG. 32 relay 4200 is shown with actuator or relay 4110 elevated from actuator or relay 4114. In this configuration, the release mechanism 4143 is in a horizontal position such that it is located slightly above the surface upon which it is supported. Accordingly and as an object or toy vehicle 4202 is released from relay 4110 it travels downwardly in the direction of arrow 4204 towards target surface 4145 of release mechanism 4143 and thus moves the same from the elevated horizontal position towards the surface it is supported thereon thereby activating launcher 4149 (e.g., movement of the mechanism from the second position towards another position, which may or may not be the first position).

Figure 33D:
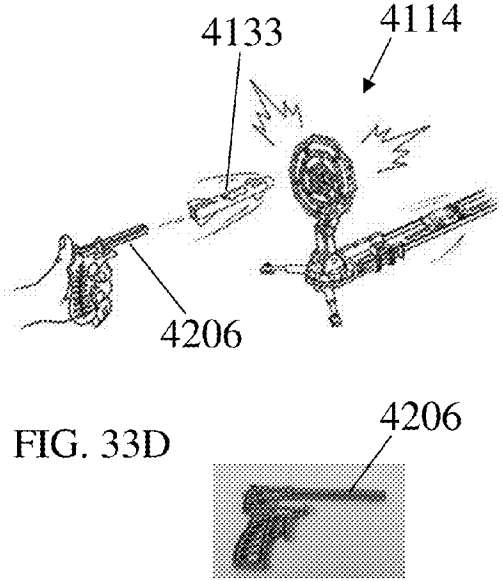
Figure 33C:
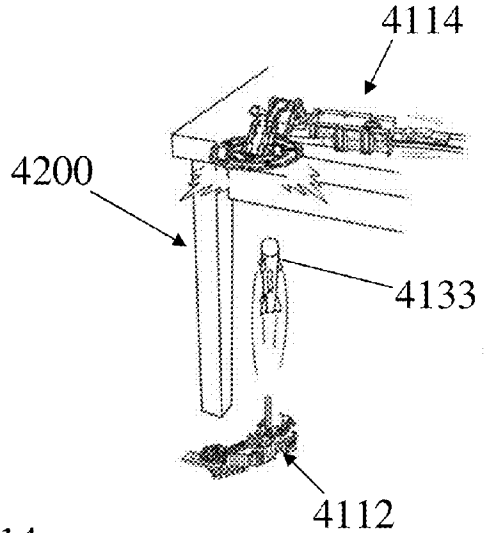
Figure 33B:
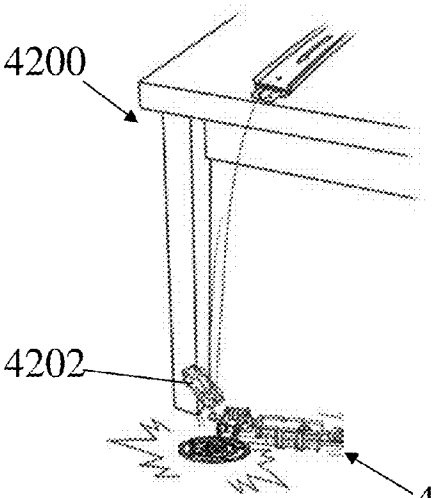
Figure 33A:
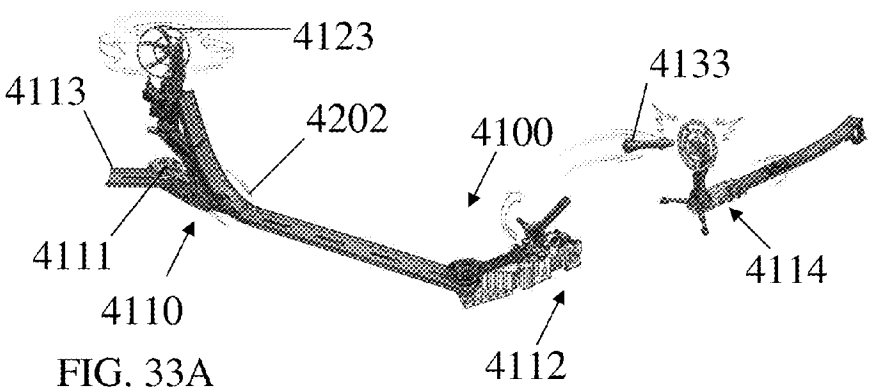

FIGS. 33A-33D illustrate just some of the numerous configurations contemplated in accordance with exemplary embodiments of the present invention and FIG. 33D illustrates an embodiment wherein missile 4133 is launched from a hand held device or gun 4206 wherein an individual aims the missile directly at the release mechanism of the relay 4114.

Exemplary embodiments of the present invention provide relay segments or actuators that are easy to assemble and operate stunts that can be rearranged and repositioned for numerous play configurations.

While the present invention has been described in terms of specific embodiments, it should be appreciated that the spirit and scope of the invention is not limited to those embodiments. The features, functions, elements and/or properties, and/or combination and combinations of features, functions, elements and/or properties of the track set may be claimed in this or a related application. All subject matter which comes within the meaning and range of equivalency of the claims is to be embraced within the scope of such claims.

What is claimed is:

1. A relay for a toy, comprising:

a first actuator configured to launch a first object into air;

a second actuator;

a release mechanism moveably secured to the second actuator for movement between a first position and a second position wherein movement of the release mechanism from either the first position towards the second position or the second position towards the first position by the first object causes the second actuator to propel a second object away from the second actuator and wherein the release mechanism is rotatably secured to the second actuator for rotational movement in a first plane, the first plane being parallel to either the first position or the second position of the release mechanism, wherein the first actuator further comprises a moveable member pivotally secured to the first actuator for movement from a first position to a second position and wherein the first actuator launches the first object in the air when the moveable member is moved to the second position from the first position.

2. The relay as in claim 1, wherein there is no physical connection between the first actuator and the second actuator.

3. The relay as in claim 1, wherein the first actuator is coupled to a first vehicle track segment and the second actuator is coupled to a second vehicle track segment and the second object is a toy vehicle propelled on the second vehicle track segment by the second actuator.

4. The relay as in claim 3, wherein the first vehicle track segment is pivotally mounted to the first actuator.

5. The relay as in claim 1, wherein the second actuator further comprises a pair of support legs each being pivotally mounted to the second actuator.

6. The relay as in claim 5, wherein the pair of support legs are configured to be received within a complimentary pair of openings in the first actuator.

7. The relay as in claim 1, wherein the moveable member further comprises a conically shaped surface positioned above a first track segment pivotally secured to the first actuator.

8. The relay as in claim 1, wherein the first object is configured to resemble a missile.

9. The relay as in claim 1, wherein the release mechanism further comprises a target surface secured to an arm member, wherein the arm member is moveably mounted to the second actuator for movement between the first position and the second position.

10. The relay as in claim 9, wherein the target surface is vertically arranged with respect to the second actuator when the arm member is in the first position and the wherein the target surface is horizontally arranged with respect to the second actuator when the arm member is in the second position.

11. The relay as in claim 1, wherein the first actuator further comprises a first launcher for launching the object into the air wherein the first launcher is pivotally secured to the first actuator such that the first object may be launched into the air from a plurality of angles with respect to the first actuator.

12. The relay as in claim 1, wherein the movable member of the first actuator is pivotally secured to the relay segment proximate to a first vehicle track segment pivotally mounted to the first actuator for adjustable movement with respect to the first actuator; and a launching element for launching the first object into the air when the movable member is moved from the first position to the second position.

13. The relay as in claim 12, wherein the movable member further comprises an angled surface positioned above the first track segment and the first position locates the angled surface a first distance from the first vehicle track segment while the second position locates the angled surface a second distance from the first vehicle track segment, the second distance being greater than the first distance.

14. The relay as in claim 13, wherein the first distance is less than a height of a toy vehicle traveling on the first vehicle track segment, wherein the toy vehicle is a 1:50 scale model or less and the first object is a toy missile.

15. An interchangeable toy track set, comprising:

a plurality of interchangeable relays each of which may be coupled to each other to create a plurality of variations for the toy track set; and wherein at least one of the plurality of interchangeable relays comprises:

a first actuator configured to launch a first object into air;

a second actuator;

a release mechanism moveably secured to the second actuator for movement between a first position and a second position wherein movement of the release mechanism from either the first position towards the second position or the second position towards the first position by the first object causes the second actuator to propel a second object away from the second actuator and wherein the release mechanism is rotatably secured to the second actuator for rotational movement in a first plane, the first plane being parallel to either the first position or the second position of the release mechanism, wherein the first actuator further comprises a moveable member pivotally secured to the first actuator for movement from a first position to a second position and wherein the first actuator launches the first object in the air when the moveable member is moved to the second position from the first position.

16. The interchangeable toy track set as in claim 15, wherein there is no physical connection between the first actuator and the second actuator.

17. The interchangeable toy track set as in claim 15, wherein the first actuator further comprises a first launcher for launching the object into the air wherein the first launcher is pivotally secured to the first actuator such that the first object may be launched into the air from a plurality of angles with respect to the first actuator; and wherein the first launcher launches the first object into the air when the movable member is moved from the first position to the second position.

18. A method for actuating a plurality of relay segments of a toy track set, the method comprising:

actuating a trigger of one of a plurality of interchangeable relays linked to at least one other of the plurality of interchangeable relay segments wherein actuation of the trigger causes an object to be launched into air towards another one of the one of the plurality of interchangeable relay segments, wherein at least one of the plurality of interchangeable relays comprises:

a first actuator configured to launch the first object into the air;

a second actuator;

a release mechanism moveably secured to the second actuator for movement between a first position and a second position wherein movement of the release mechanism from either the first position towards the second position or the second position towards the first position by the first object causes the second actuator to propel a second object away from the second actuator and wherein the release mechanism is rotatably secured to the second actuator for rotational movement in a first plane, the first plane being parallel to either the first position or the second position of the release mechanism, and wherein the trigger of the first actuator further comprises a moveable member pivotally secured to the first actuator for movement from a first position to a second position and wherein the first actuator launches the first object in the air when the moveable member is moved to the second position from the first position.

* * * * *